US007134292B2

(12) United States Patent
Oh

(10) Patent No.: US 7,134,292 B2
(45) Date of Patent: Nov. 14, 2006

(54) FULL ICE LEVEL SENSING APPARATUS AND METHOD

(75) Inventor: Seung Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/847,454

(22) Filed: May 18, 2004

(65) Prior Publication Data

US 2005/0072167 A1 Apr. 7, 2005

(30) Foreign Application Priority Data

Oct. 7, 2003 (KR) ..... 10-2003-0069608

(51) Int. Cl.
*F25C 1/04* (2006.01)

(52) U.S. Cl. ..... 62/137; 62/353

(58) Field of Classification Search ..... 62/66–74, 62/137, 340–356; 340/612
See application file for complete search history.

(56) References Cited

U.S. PATENT DOCUMENTS

| | | | | |
|---|---|---|---|---|
| 2,981,079 | A | 4/1961 | Fink | |
| 3,045,444 | A * | 7/1962 | Todd | 62/137 |
| 3,601,145 | A * | 8/1971 | Eyman et al. | 137/368 |
| 3,885,400 | A * | 5/1975 | Webb | 62/137 |
| 4,872,317 | A | 10/1989 | Reed | |
| 4,872,318 | A | 10/1989 | Klemmensen | |
| 5,970,725 | A | 10/1999 | Lee | |
| 6,050,097 | A | 4/2000 | Nelson et al. | |
| 6,082,130 | A | 7/2000 | Pastryk et al. | |
| 6,334,318 | B1 | 1/2002 | Ando et al. | |
| 6,334,319 | B1 | 1/2002 | Senner | |
| 6,574,974 | B1 | 6/2003 | Herzog et al. | |
| 2002/0083726 | A1 | 7/2002 | Kim et al. | |

FOREIGN PATENT DOCUMENTS

| | | |
|---|---|---|
| GB | 1003619 | 11/1963 |
| JP | 52-51148 | 4/1977 |
| JP | 62-251388 | 11/1987 |
| JP | 9-178316 | 7/1997 |
| JP | 10-103830 | 4/1998 |
| WO | 03/016796 | 2/2003 |

OTHER PUBLICATIONS

English language Abstract of JP52-51148.
English language Abstract of JP 9-178316.
English Language Abstract of JP 10-103830.
English Language Abstract of JP 62-251388.

* cited by examiner

*Primary Examiner*—William E. Tapolcai
(74) *Attorney, Agent, or Firm*—Greenblum & Bernstein, P.L.C.

(57) ABSTRACT

Disclosed are a full ice level sensing apparatus and method in which a full ice level of ice cubes in an ice bank is sensed by means of upward and downward movements of an elevating member, thereby minimizing an operational area of the elevating member required to sense the full ice level and increasing an effective volume of a freezing chamber. The full ice level sensing apparatus includes an elevating member disposed so as to rectilinearly move up and down into the ice bank, elevating means for rectilinearly moving the elevating member upward and downward, and sensing means for sensing whether or not the ice bank is at the full ice level based on the position of the elevating member.

19 Claims, 20 Drawing Sheets

FULL ICE LEVEL SENSING APPARATUS AND METHOD

BACKGROUND OF THE INVENTION

1. Field of the Invention

The present invention relates to a full ice level sensing apparatus and method for a refrigerator, and more particularly to a full ice level sensing apparatus and method in which a full ice level of ice cubes in an ice bank is sensed by means of the upward and downward movements of an elevating member.

2. Description of the Related Art

Generally, refrigerators maintain a freezing chamber or a refrigerating chamber at a low temperature using a refrigerating cycle device, which comprises a compressor, a condenser, an expansion unit and an evaporator, by means of a refrigerant.

FIG. 1 is a perspective view of a conventional refrigerator, in which a freezing chamber door and a refrigerating chamber door are opened.

As shown in FIG. 1, the conventional refrigerator comprises a barrier 1 for dividing the inside of the refrigerator into a freezing chamber (F) and a refrigerating chamber (R), a main body 2 provided with a refrigerating cycle device for cooling the freezing chamber (F) and the refrigerating chamber (R) at a low temperature, a freezing chamber door 4 rotatably connected to the main body 2 for opening and closing the freezing chamber (F), and a refrigerating chamber door 6 rotatably connected to the main body 2 for opening and closing the refrigerating chamber (R).

The refrigerating cycle device includes a compressor for compressing a refrigerant in a low-temperature and low-pressure state to a high-temperature and high-pressure state, a condenser for condensing the refrigerant in the high-pressure state compressed by the compressor by emitting heat to outdoor air, an expansion unit for decompressing the refrigerant condensed by the condenser, and an evaporator for evaporating the refrigerant expanded by the expansion unit by absorbing heat from the freezing chamber (F) or the refrigerating chamber (R).

Recently, an automatic ice-making device for making ice by means of cool air in the freezing chamber (F) and then for exhausting the ice is installed in the refrigerator.

The automatic ice-making device includes an ice-maker 8 installed at an upper portion of the inside of the freezing chamber (F) for freezing water supplied thereto by means of cool air in the freezing chamber (F), an ice bank 9 installed in the freezing chamber (F) for containing ice cubes made by the ice-maker 8, a dispenser 10 installed at the freezing chamber door 4 for exhausting the ice cubes without opening the freezing chamber door 4, and an ice chute 11 for guiding the ice cubes contained in the ice bank 9 to drop down to the dispenser 10.

FIG. 2 is a perspective view illustrating the ice-maker and the ice bank for the conventional refrigerator. FIG. 3 is a schematic view of a controller of the ice-maker for the conventional refrigerator.

The ice-maker 8 includes an ice-maker mold 12 for containing water to be frozen and freezing the water into ice cubes having a designated shape, a water supply unit 13 for supplying the water into the ice-maker mold 12, a slider 14 for guiding the ice cubes into the ice bank 9, and a heater for separating the ice cubes from the ice-maker mold 12.

Here, the ice-maker mold 12 is connected to the freezing chamber of the refrigerator by a connection unit 12*a*.

The ice-maker 8 further includes an ice-making controller 16, and an ejector 17 axially connected to a motor of the ice-making controller 16 for exhausting the ice cubes made by the ice-maker mold 12 to the ice bank 10.

The ice-maker mold 12 has an approximately semi-cylindrical shape, and includes a plurality of partition plates 12*a* spaced from each other by designated intervals for allowing the plural ice cubes to be divisionally made.

Further, the ejector 17 includes a shaft 17*a* traversing the ice-maker mold 12, and a plurality of ejector pins 17*b* installed at the side wall of the shaft 17*a*.

Here, each of the ejector pins 17*b* is positioned between the partition plates 12*b* of the ice-maker mold 12.

The ejector pins 17*a* serve as means for exhausting the made ice cubes to the ice bank 10.

The ice cubes transferred by the ejector pins 17*a* are put on the slider 14, and are then dropped to the ice bank 9 along the surface of the slider 14.

Further, the heater is attached to the bottom of the ice-maker mold 12, and serves to increase the temperature of the ice-maker mold 12 so as to separate the ice cubes from the ice-maker mold 12 by melting the ice cubes at portions thereof adhered to the surface of the ice-maker mold 12. The ejector 17 transfers the separated ice cubes.

Before the ice cubes are separated from the ice-maker mold 12, a sensing lever 18 determines whether or not the ice bank 10 positioned below the ice-maker mold 12 is fully filled with the ice cubes (hereinafter, referred to as "at a full ice level").

Here, the sensing lever 18 is designed such that both ends of the sensing lever 18 are rotatably attached to both sides of the ice-maker 8 and the sensing lever 18 is outwardly bent at designated portions.

The ice-making controller 16 includes a control panel 21, a magnet 22 rotated by the rotation of the sensing lever 18, a hall sensor 23 for sensing a magnetic field generated from the magnet 22 when the rotation of the sensing lever 18 is limited by the amount of the ice cubes at the full ice level, a motor 24 for generating a driving force for rotating the sensing lever 18 and the ejector 17, a driving gear 25 axially connected to a shaft of the motor 24, a driven gear 26 interdigitated with the driving gear 25 and provided with a rotary shaft 26*a* connected to the shaft 17*a* of the ejector 17, a cam 27 protruded from the rotary shaft 26*a* of the driven gear 26, and an arm lever 28 geared with the cam 27 for rotating the sensing lever 18.

Here, the magnet 22 is installed at an extension portion 18*a* of the sensing lever 18.

The rotary frequency of the cam 27 is transmitted to the arm lever 28 for vertically moving the sensing lever 18.

The hall sensor 23 is installed on the control panel 21, and is positioned such that the variation in the magnetic field generated by the movement of the magnet 22 is sensed by the hall sensor 23.

That is, the hall sensor 23 senses the magnetic field through the variation in the rotary position of the magnet 22 generated by the rotation of the sensing lever 18, thereby determining whether or not the ice bank 9 is at the full ice level.

Since the sensing lever 18 of the above-described full ice level sensing apparatus is outwardly bent at designated portions and is rotated so as to sense the full ice level, the sensing level 18 requires a large area for operation, thereby reducing an effective volume of the freezing chamber (F).

SUMMARY OF THE INVENTION

Therefore, the present invention has been made in view of the above problems, and it is an object of the present invention to provide a full ice level sensing apparatus for sensing whether or not an ice bank containing ice cubes is at a full ice level such that an operational area of an elevating member required to sense the full ice level is minimized and an effective volume of a freezing chamber is increased.

It is another object of the present invention to provide a full ice level sensing method, in which the full ice level of an ice bank is accurately and rapidly sensed regardless of the control of an ice-maker.

In accordance with one aspect of the present invention, the above and other objects can be accomplished by the provision of a full ice level sensing apparatus comprising: an ice-maker for making ice from water supplied thereto by means of cool air; an ice bank for containing ice cubes separated from the ice-maker; an elevating member disposed so as to move up and down into the ice bank; elevating means for moving the elevating member upward and downward; and sensing means for sensing whether or not the ice bank is at a full ice level based on the position of the elevating member.

In accordance with another aspect of the present invention, there is provided a full ice level sensing method for sensing whether or not ice cubes contained in an ice bank are at a full ice level, comprising the steps of: (a) moving an elevating member downward when it is determined that a predetermined time elapses; (b) sensing the variation in a magnetic field based on the downward movement of the elevating member; (c) determining whether or not the ice bank is at the full ice level based on the obtained result in the step (b); and (d) moving the elevating member upward after the step (c), thus initializing the method.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
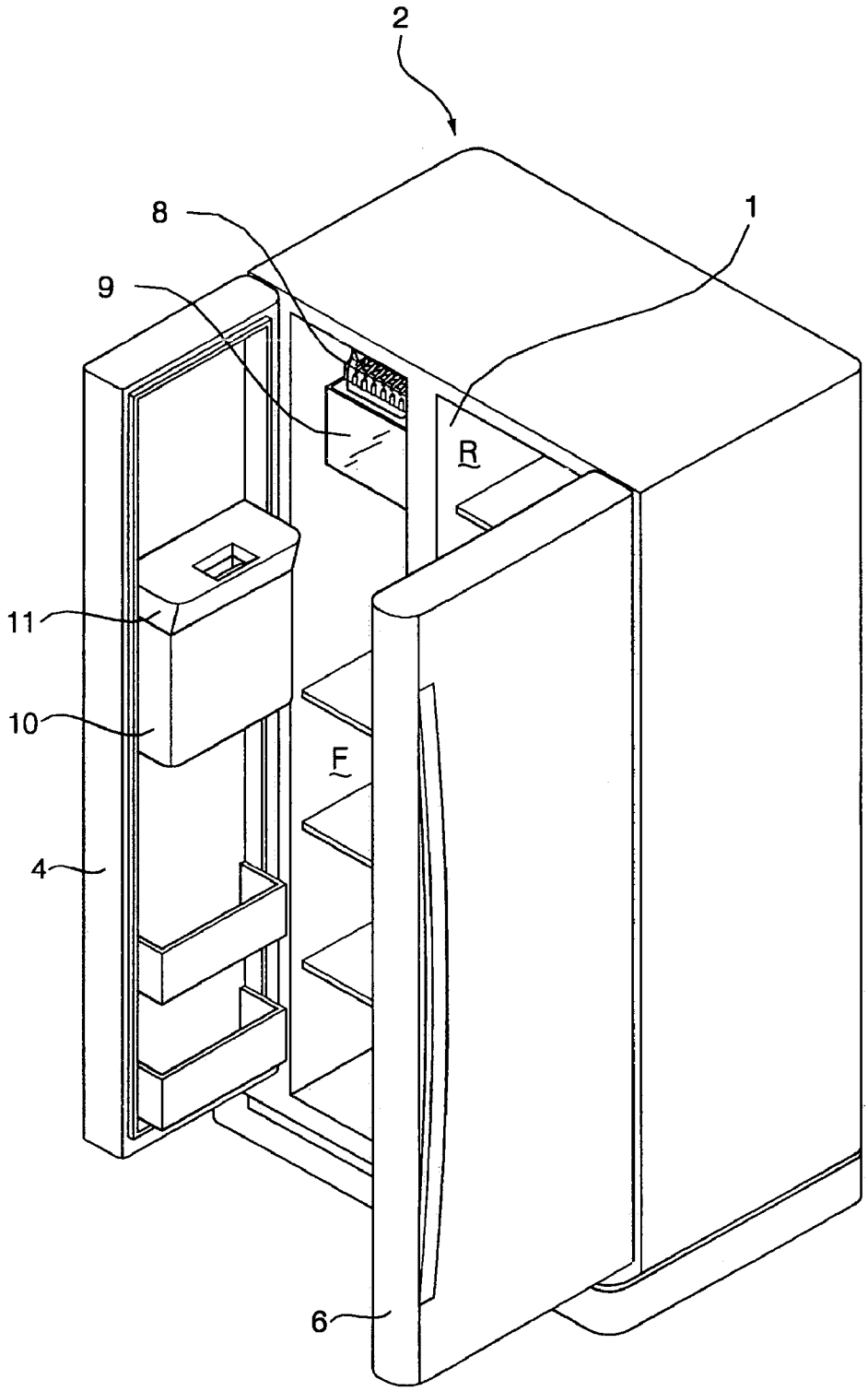
FIG. 1 (Prior Art)
FIG. 1 is a perspective view of a conventional refrigerator, in which a freezing chamber door and a refrigerating chamber door are opened.
Figure 2:
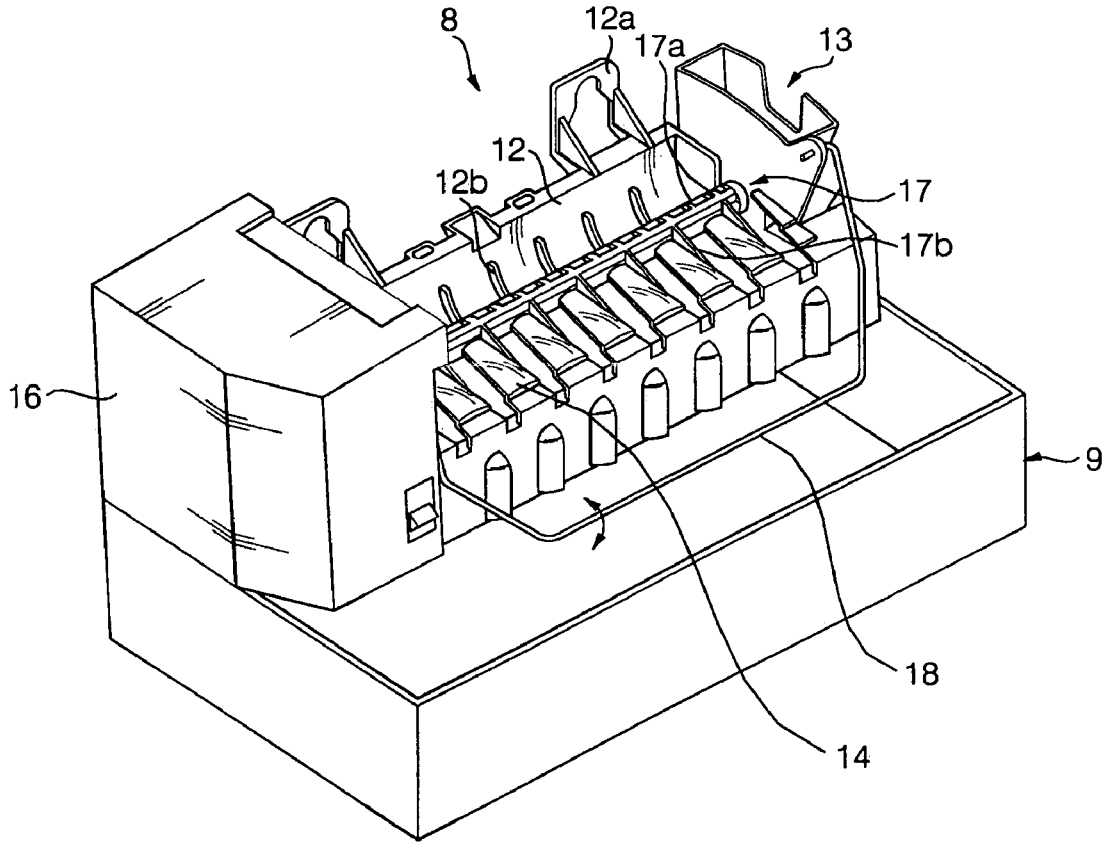
FIG. 2 (Prior Art)
FIG. 2 is a perspective view illustrating an ice-maker and an ice bank for the conventional refrigerator.
Figure 3:
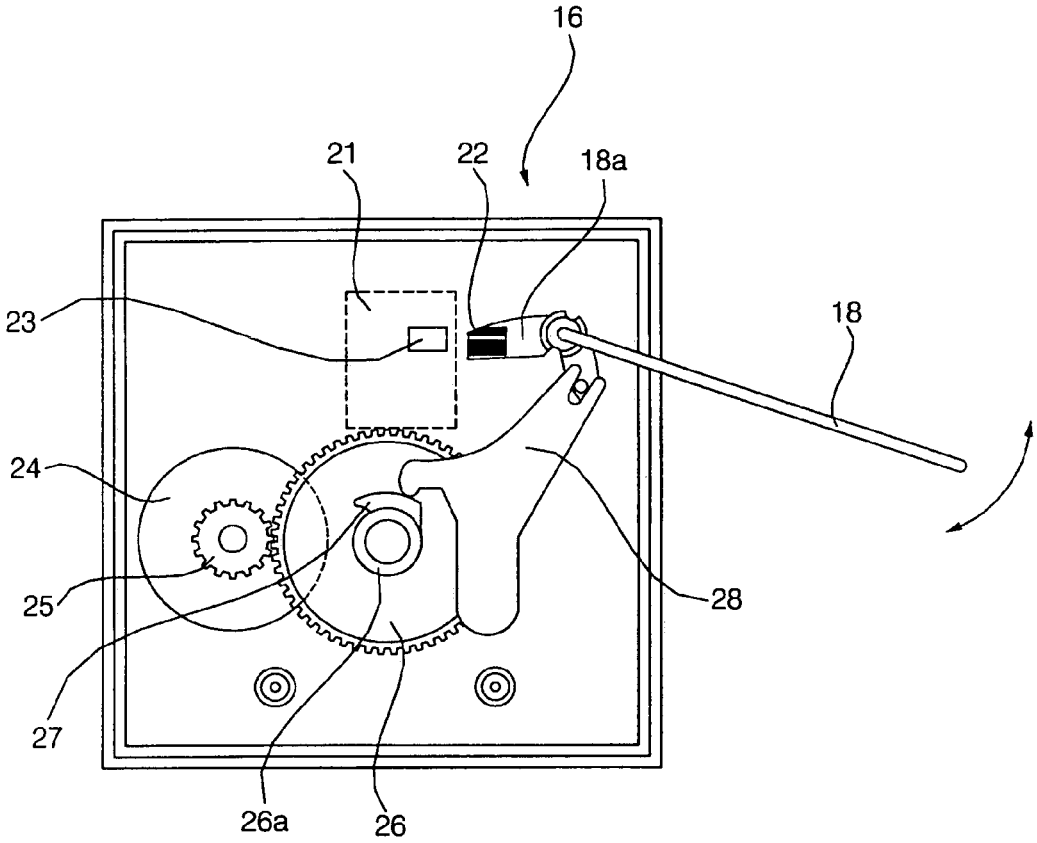
FIG. 3 (Prior Art)
FIG. 3 is a schematic view of a controller of the ice-maker for the conventional refrigerator.
Figure 4:
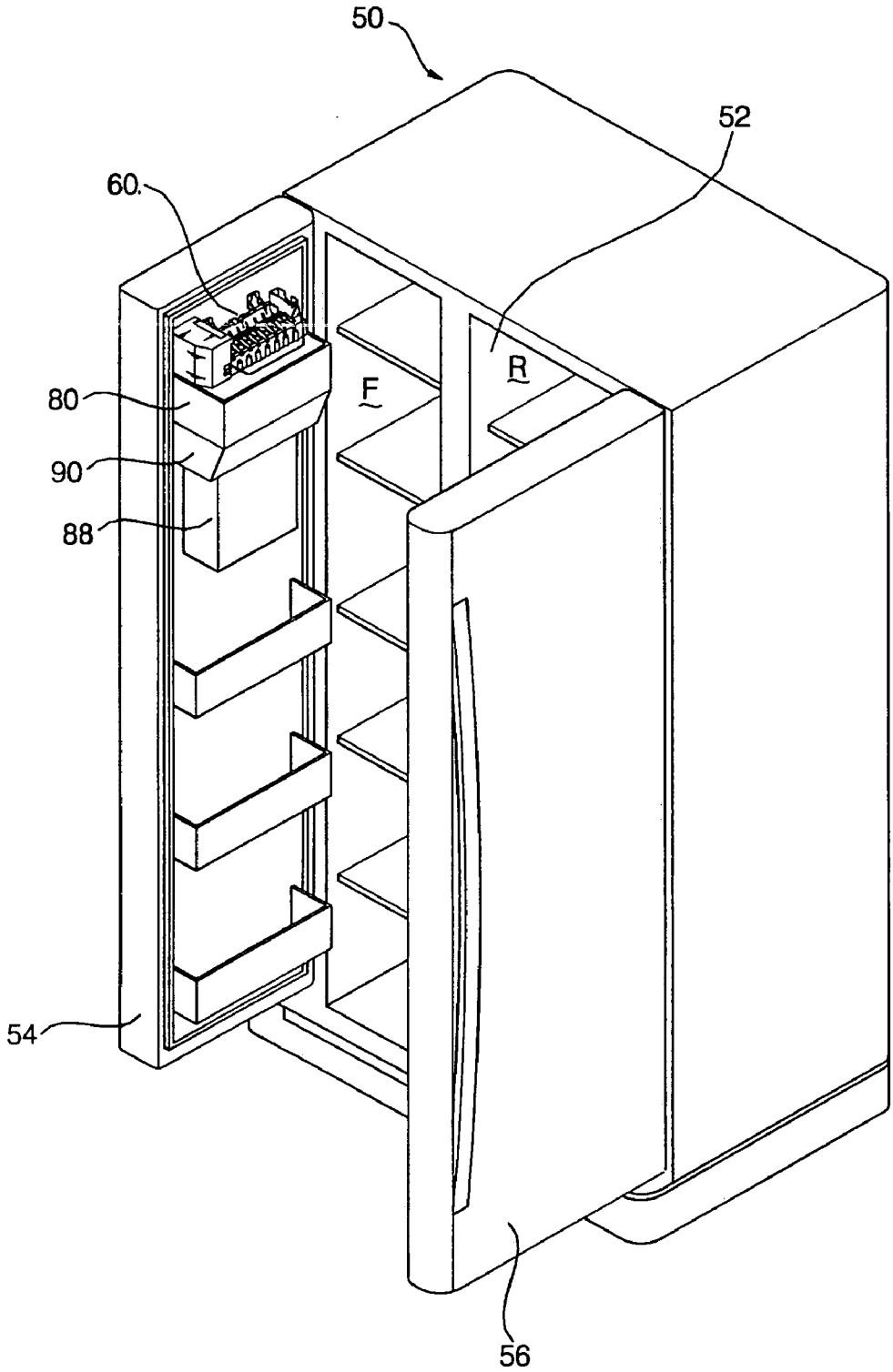
FIG. 4 is a perspective view of a refrigerator, in which a freezing chamber door and a refrigerating chamber door are opened, provide with a full ice level sensing apparatus in accordance with a first embodiment of the present invention.

FIG. 4 is a perspective view of a refrigerator, in which a freezing chamber door and a refrigerating chamber door are opened, provide with a full ice level sensing apparatus in accordance with a first embodiment of the present invention.

As shown in FIG. 4, the refrigerator in accordance with the first embodiment comprises a main body 50, a barrier 52 for dividing the inside of the main body 50 into a freezing chamber (F) and a refrigerating chamber (R), a freezing chamber door 54 rotatably connected to the main body 50 for opening and closing the freezing chamber (F), and a refrigerating chamber door 56 rotatably connected to the main body 50 for opening and closing the refrigerating chamber (R).

At the freezing chamber door 54, an ice-maker 60 for making ice from supplied water by means of cool air of the freezing chamber (F), an ice bank 80 for containing ice cubes made by the ice-maker 60, a dispenser 88 for exhausting the ice cubes to the outside without opening the freezing chamber door 54, and an ice chute 90 for guiding the ice cubes contained in the ice bank 80 to drop to the dispenser 88.

The ice-maker 60 is installed at the rear surface of the freezing chamber door 54 so as to increase an effective volume of the freezing chamber (F).

The ice bank 80 is installed at the rear surface of the freezing chamber door 54 so as to increase the effective volume of the freezing chamber (F).

The dispenser 88 is provided with an opened front surface through which a container for the ice cubes comes into and out of the dispenser 88, and closed side and rear surfaces.

The ice chute 90 is installed at the rear surface of the freezing chamber door 54 such that the ice chute 90 is positioned between the ice bank 80 and the dispenser 88. An upper end of the ice chute 90 communicates with an ice outlet of the ice bank 80, and a lower end of the ice chute 90 communicates with the inside of the dispenser 88.

Figure 5:
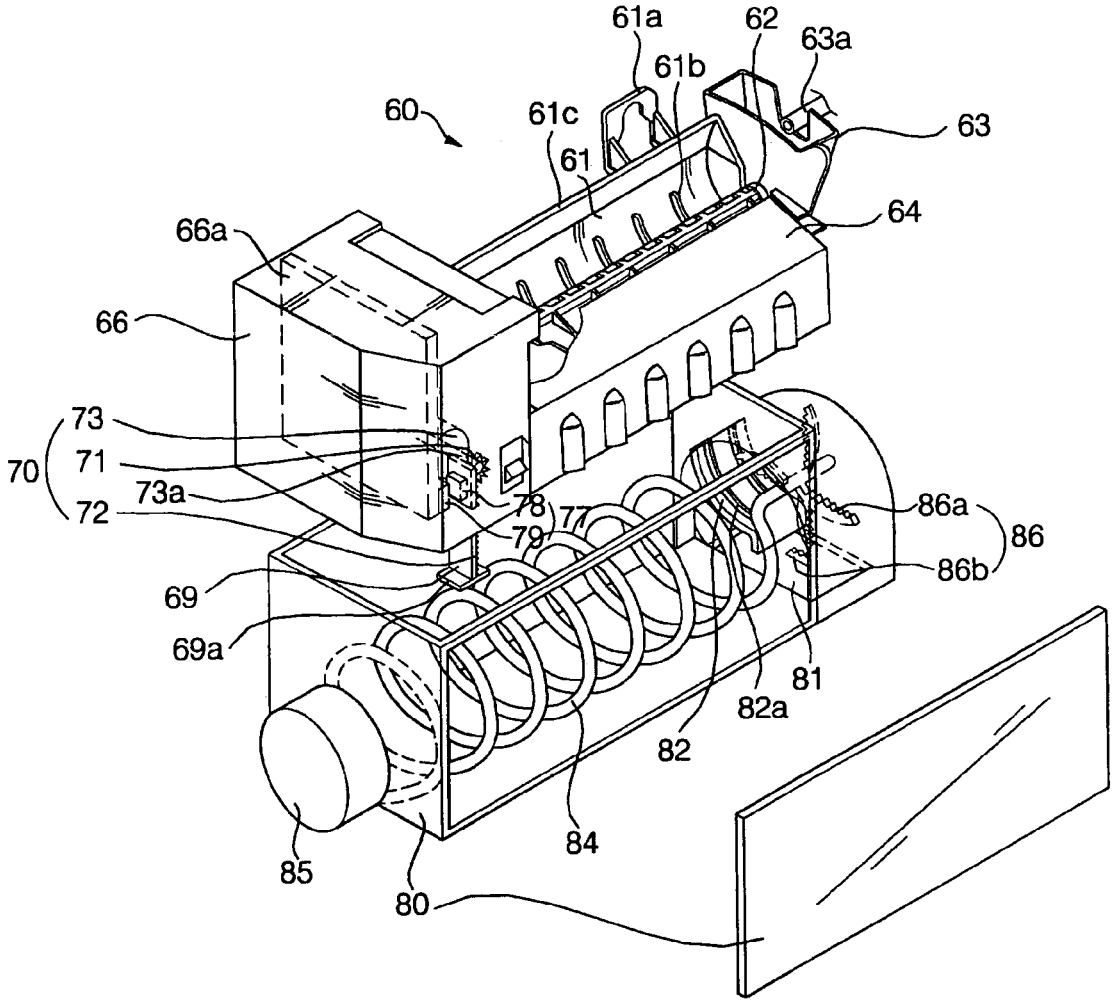
FIG. 5 is an enlarged perspective view illustrating an ice-maker and an ice bank for the refrigerator provided with the full ice level sensing apparatus in accordance with the first embodiment of the present invention.
Figure 6:
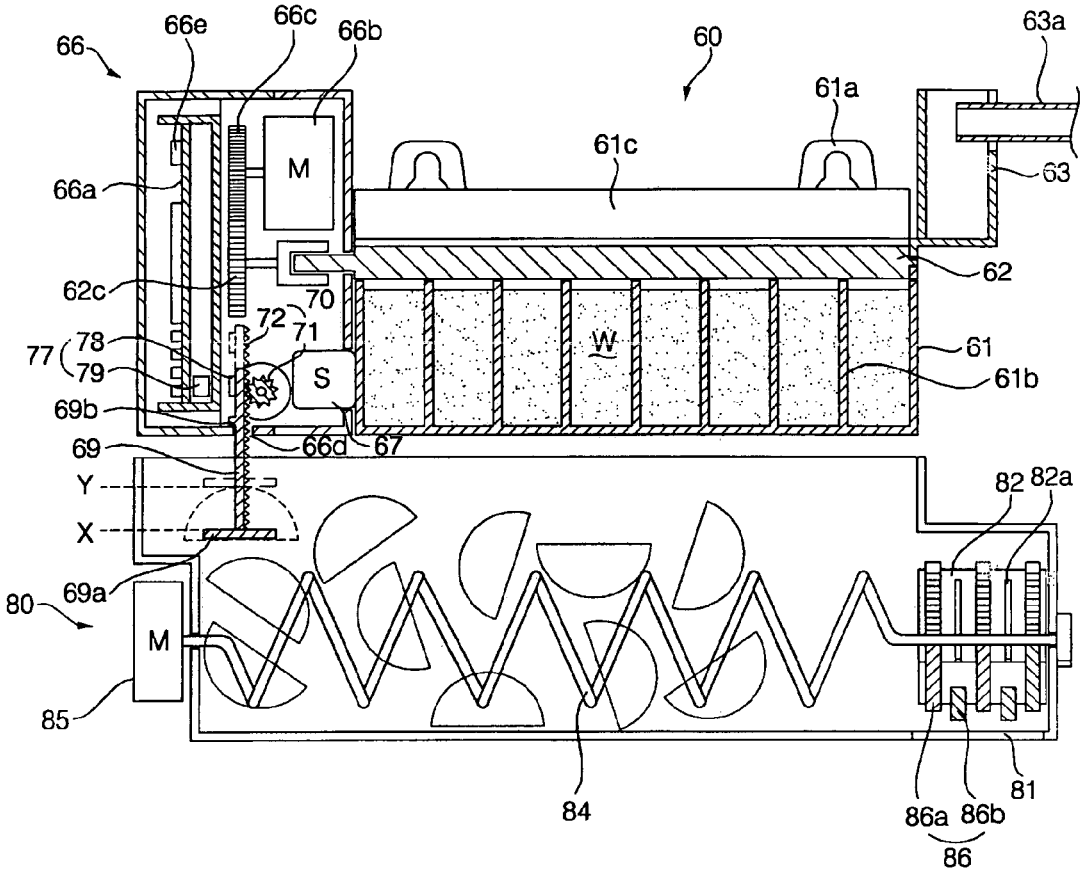
FIG. 6 is a cross-sectional view illustrating the ice-maker and the ice bank for the refrigerator provided with the full ice level sensing apparatus in accordance with the first embodiment of the present invention.
Figure 7:
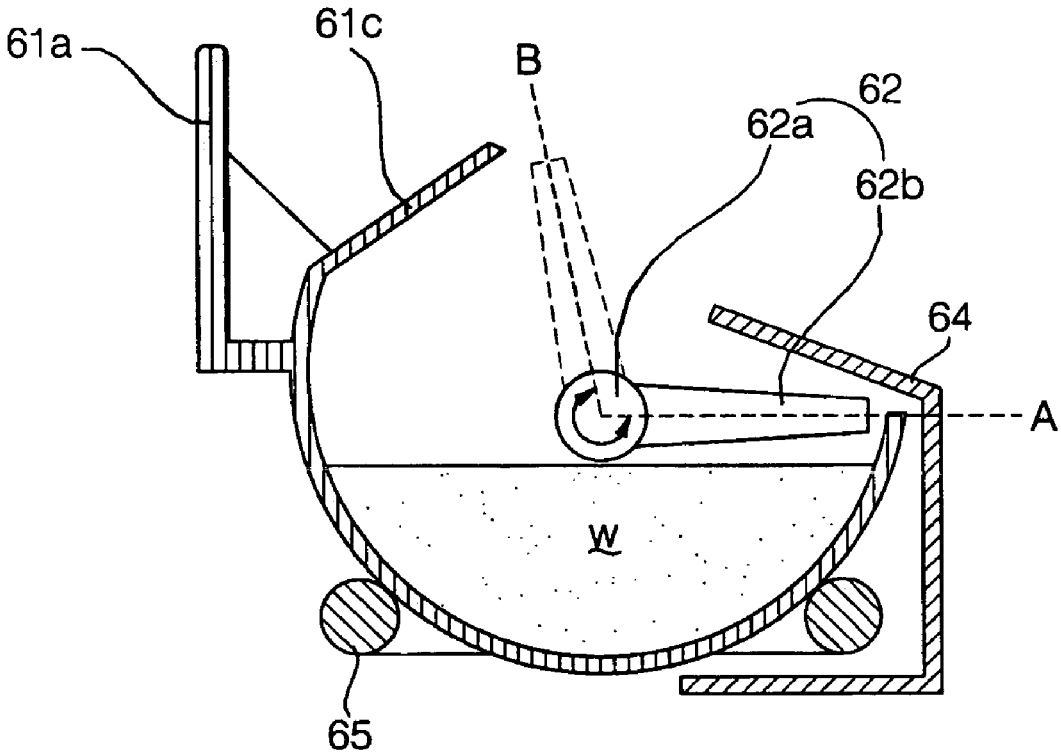
FIG. 7 is a longitudinal-sectional view illustrating the ice-maker for the refrigerator provided with the full ice level sensing apparatus in accordance with the first embodiment of the present invention.

FIG. 5 is an enlarged perspective view illustrating the ice-maker and the ice bank for the refrigerator provided with the full ice level sensing apparatus in accordance with the first embodiment of the present invention. FIG. 6 is a cross-sectional view illustrating the ice-maker and the ice bank for the refrigerator provided with the full ice level sensing apparatus in accordance with the first embodiment of the present invention. FIG. 7 is a longitudinal-sectional view illustrating the ice-maker for the refrigerator provided with the full ice level sensing apparatus in accordance with the first embodiment of the present invention.

As shown in FIGS. 5 to 7, the ice-maker 60 includes an ice-maker mold 61 having an ice-making space provided with an opened upper surface for making ice from the water supplied thereinto, and an ejector 62 for separating ice cubes made by the ice-maker mold 61 from the ice-making space.

A cup 63 for containing water supplied through a supply hose 63*a* and transferring the water into the ice-making space of the ice-maker mold 61 is installed at one side of the ice-maker mold 61.

A connection portion 61*a* for fixing the ice-maker mold 61 to the rear surface of the freezing chamber door 54 is protruded from the upper portion of the front surface of the ice-maker mold 61.

The ice-making space having a semi-cylindrical shape is longitudinally formed in the ice-maker mold 61, and a plurality of partition plates 61*a* for causing a plurality of ice cubes to be divisionally made are spaced from each other by a designated interval in the ice making space.

A flat-type overflow prevention unit 62*c* is upwardly extended from the front surface of the ice-maker mold 61.

A slider 64 for guiding ice cubes drawn up by the ejector 62 into the ice bank 80 is installed at the rear surface of the ice-maker mold 61.

The slider 64 is provided with a flat-type upper surface so that the guided ice cubes are slidably dropped along the slider 64 and the water contained in the ice-maker mold 61 does not overflow the ice-maker mold 61.

As shown in FIG. 7, the ejector 62 includes a shaft 62*a* traversing the upper part of the ice-making space, and a plurality of pins 62*b* protruded from the side wall of the shaft 62*a*.

One end of the shaft 62*a* is rotatably supported by the cup 63, and the other end of the shaft 62*a* is protruded toward the inside of an ice-making controller 66, which will be described later, and is connected to the driven gear 62*c*.

The pins 62*b* are prepared in the same number as that of the units of the ice making space divided by the partition plates 62*a*, and serve to draw up the ice cubes by passing through the units between the partition plates 62*a* when the shaft 62*a* is rotated.

A heater 65 for heating the ice-maker mold 61 is installed at the ice-maker 60 such that the ice cubes are separated from the ice-maker mold 61.

As shown in FIG. 7, the heater 65 having a "⊃" shape is positioned on the bottom of the ice-maker mold 61.

The ice-making controller 66 includes a control panel 66*a* for controlling the heater 65 and the ejector 62, as well as controlling a water supply valve intermitting the water supplied into the cup 63 according to the temperature of the ice-maker mold 61 and whether or not the ice bank 80 is at the full ice level, and a driving motor 66*b* for generating a driving force for rotating the ejector 62.

A driving gear 66*c* interdigitated with the driven gear 62*c* is connected to a rotary shaft of the driving motor 66*b*.

The ice-making controller 66 is provided with a temperature sensor 67 for sensing the temperature of the ice-maker mold 61, and the full ice level sensing apparatus for sensing whether or not the ice bank 80 is at the full ice level.

The temperature sensor 67 is attached to an external wall of the ice-maker mold 61.

The full ice level sensing apparatus includes an elevating member 69 rectilinearly moving up and down in the ice bank 80, an elevating means 70 for rectilinearly moving the elevating member 69 upward and downward, and a sensing means 77 for sensing whether or not the ice bank 80 is at the full ice level according to the position of the elevating member 69.

An extension portion 69*a* for increasing the accuracy of sensing the ice full level is protruded from the lower end of the elevating member 69.

The elevating member 69 is vertically positioned on the bottom of the ice-maker 60 so as to minimize an operational area of the elevating member 69.

A stopper 69*b* for restricting the downward stripping of the elevating member 69 is installed at one side of the ice-maker 60.

The elevating member 69 is made of an elastic material, thus being partially warped when the elevating member 69 is restricted by the ice cubes in case that the ice bank 80 is at the full ice level, and preventing the motor 73 from being overloaded.

The elevating means 70 includes a pinion 71, and a rack 72 formed on one surface of the elevating member 69 such that the rack 72 is interdigitated with the pinion 71.

The elevating means 70 further includes a motor 73 having a shaft 73*a* axially connected to the pinion 71.

Here, the pinion 71 is axially connected to the motor 73, so as to be rotated. However, the pinion 71 may be geared with one of either the driving motor 66*b*, the driving gear 66*c* or the driven gear 62*c* for rotating the ejector 62, so as to be rotated.

The shaft 72 is made of an elastic material, thus being warped when the elevating member 69 is restricted by the ice cubes in case that the ice bank 80 is at the full ice level, and preventing the motor 73 from being overloaded.

The sensing means 77 includes a magnet 78 installed at one side of the elevating member 69, and a hall sensor 79 installed at the ice-maker 60 for sensing the variation in a magnetic field according to the variation in the height of the magnet 78.

Preferably, the hall sensor 79 is installed on the control panel 66*a*.

Non-described reference numeral 66*d* represents a guide hole formed through the lower surface of the ice-making controller 66 for allowing the upper end of the elevating member 69 to be inserted into the inside of the ice-making controller 66 and guiding the upward and downward movements of the elevating member 69 therethrough, and non-described reference numeral 69*e* represents a timer for allowing the full ice level sensing apparatus to be operated.

As shown in FIGS. 5 and 6, the ice bank 80 is provided with an opened upper surface for allowing the ice cubes made by the ice-maker 60 to be contained in the ice bank 80 therethrough, and an ice outlet 81 formed in a designated position of the lower portion thereof for exhausting the ice cubes therethrough.

The ice bank 80 includes a shutter 92 for opening and closing the front portion of the ice outlet 81, an auger 84 horizontally disposed for transferring the contained ice cubes to the front portion of the ice outlet 81, a motor 85 for rotating the auger 84, and an ice grinder 86 installed at the upper portion of the ice outlet 81.

Here, in case that the shutter 92 opens the front portion of the ice outlet 81, the ice cubes transferred by the auger 84 are dropped from the front portion of the ice outlet 81 without being ground. In case that the shutter 92 closes the front portion of the ice outlet 81, the ice cubes transferred by the auger 84 are elevated to the ice grinder 86, are ground by the ice grinder 86, and are then dropped to the rear portion of the ice outlet 81.

Preferably, a subsidiary blade 82*a* for assisting the grinding of the ice grinder 86 is protruded from the shutter 82.

The ice grinder 86 includes a rotary blade 86*a* being orthogonal to a rotary shaft of the auger 84 and rotated by the rotation of the auger 84, and a fixed blade 86*b* installed at the inside of the ice bank 80.

Hereinafter, operations of the ice-maker and the full ice level sensing apparatus for the refrigerator in accordance with the present invention will be described in detail.

First, when power is inputted to the refrigerator, the control panel 66*a* controls the motor 66*b* to set the pins 62*b* of the ejector 62 to an initial position (A).

Thereafter, the control panel 66*a* switches on the supply valve intermitting the water supplied to the cup 63 for a designated time, and then switches off the supply valve.

The water supplied from the outside during the time taken to switch on the supply valve is contained in the cup 63, and is then transferred into the ice-making space of the ice-maker mold 61.

Thereafter, the water contained in the ice-maker mold 61 is heat-exchanged with cool air in the freezing chamber (F) or the ice-maker mold 61, thereby being cooled and gradually frozen, starting from the portion thereof contacting the cool air or the ice-maker mold 61.

In case that the temperature of the ice-maker mold 61 sensed by the temperature sensor 67 is lower than a predetermined temperature (for example, −7° C.), the control panel 66*a* determines that the ice making is completed, and switches on the heater 65 and then switches off the heater 65 when a predetermined time (for example, 2 minutes) from the switching-on of the heater 65 elapses or the temperature of the ice-maker mold 61 is higher than a second predetermined temperature (for example, −2° C.).

By the switching-on of the heater 65, the temperature of the ice-maker mold 61 is raised, and the made ice rubes are melted at a portion thereof contacting the ice-maker mold 61 and are then separated from the ice-maker mold 61.

Thereafter, the control panel 66*a* controls the driving motor 66*b* to rotate the pins 62*b* of the ejector 62 from the initial position (A) to an ice-separating position (B), and then to return the pins 62*b* of the ejector 62 to the initial position (A).

The ice cubes positioned in the ice-maker mold 61 are drawn up by the rotation of the ejector 62, and are dropped to the slider 64. Then, the ice cubes are guided by the slider 64, and are transferred to the ice bank 80.

The control panel 66*a* determines whether or not the water supply, the ice-making, the heating, and the ice-separating are repeated according to the full ice level of the ice bank 80 sensed by the full ice level sensing apparatus.

That is, in case that it is determined that the ice bank 80 is not at the full ice level, the control panel 66*a* allows the water supply, the ice-making, the heating, and the ice-separating to be repeated. In case that it is determined that the ice bank 80 is at the full ice level, the control panel 66*a* stops the above series of steps, i.e., the water supply, the ice-making, the heating, and the ice-separating.

Figure 8:
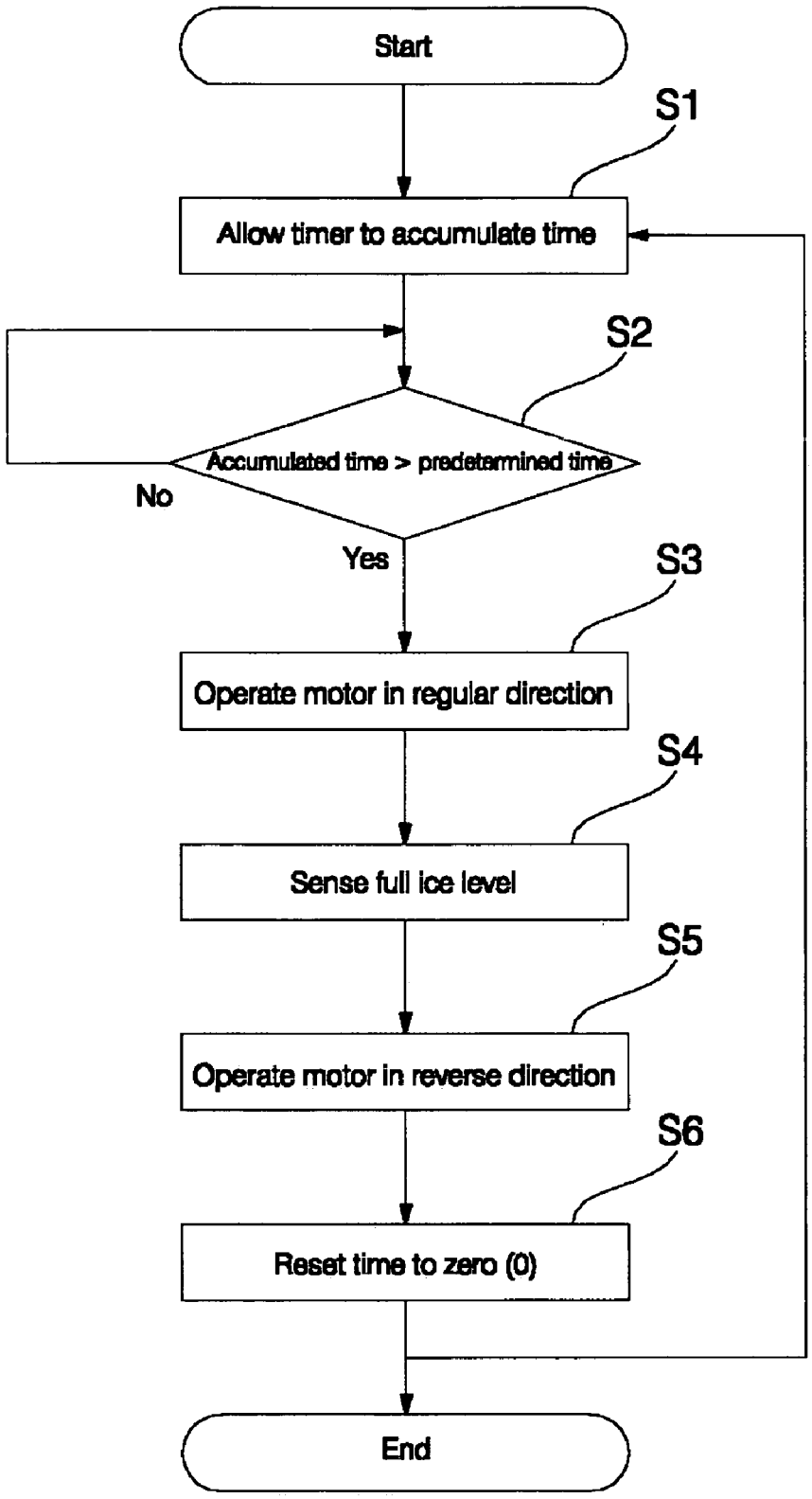
FIG. 8 is a flow chart illustrating a full ice level sensing method in accordance with the present invention.

FIG. 8 is a flow chart illustrating a full ice level sensing method in accordance with the present invention.

First, the timer 69*e* accumulates time (S1).

The control panel 66*a* compares the accumulated time of the timer 69*e* to a predetermined time (for example, 3 minutes), and in case that it is determined that the accumulated time is more than the predetermined time, the control panel 66*a* rotates the motor 73 of the full ice level apparatus in a regular direction so as to move the elevating member 69 downward (S2 and S3).

In the regular directional rotation of the motor 73, the rotary shaft 73*a* is rotated to rotate the pinion 71, and the elevating member 69 including the pinion 71 and the rack 72 interdigitated with the pinion 71 rectilinearly moves down to the inside of the ice bank 80. Here, the position of the magnet 78 is lowered.

The hall sensor 79 senses the variation in a peripheral magnetic field according to the variation in the position of the magnet 78, thereby outputting a corresponding signal to the control panel 66*a* of the ice-making controller 66, and the control panel 66*a* receives the signal outputted from the hall sensor 79, thereby determining whether or not the ice bank 80 is at the full ice level (S4).

In case that it is determined that the ice bank 80 is not at the full ice level, when the elevating member 69 vertically moves down to the inside of the ice bank 80 and reaches a position (X) corresponding to the non-full ice level of the ice bank 80, the hall sensor 79 senses a magnetic field having a value greater than a predetermined value by means of the approximation of the magnet 78, and thus the control panel 66*a* determines that the ice bank 80 is not at the full ice level.

On the other hand, in case that it is determined that the ice bank 80 is at the full ice level, the elevating member 69 is restricted by the ice cubes (I) in the ice bank 80 and does not move down below a position (Y) corresponding to the full ice level of the ice bank 80, the hall sensor 79 does not sense a magnetic field having a value greater than the predetermined value, and thus the control panel 66*a* determines that the ice bank 80 is at the full ice level.

After the determination of the full ice level in the ice bank, the control panel 66*a* rotates the motor 73 of the full ice level apparatus in the reverse direction so as to move the elevating member 69 upward (S5).

In the reverse directional rotation of the motor 73, the rotary shaft 73*a* is rotated to rotate the pinion 71, and the elevating member 69 including the pinion 71 and the rack 72 interdigitated with the pinion 71 rectilinearly moves up to the inside of the ice-making controller 66. Here, the position of the magnet 78 is heightened, and the elevating member 69 and the magnet 78 await a next sensing mode.

Thereafter, the control panel 66*a* resets the accumulated time of the timer 69*e* to zero (0), thereby initializing the timer 69*e* (S6).

After the initialization, the control panel 66*a* repeats the time accumulation, the rectilinear descent of the elevating member, the sensing of the magnetic field, the determination of the full ice level, the rectilinear ascent of the elevating member and the initialization several times, and senses the full ice level of the ice bank 80 at intervals of a predetermined time (for example, 3 minutes) during the above repetition.

Figure 9A:
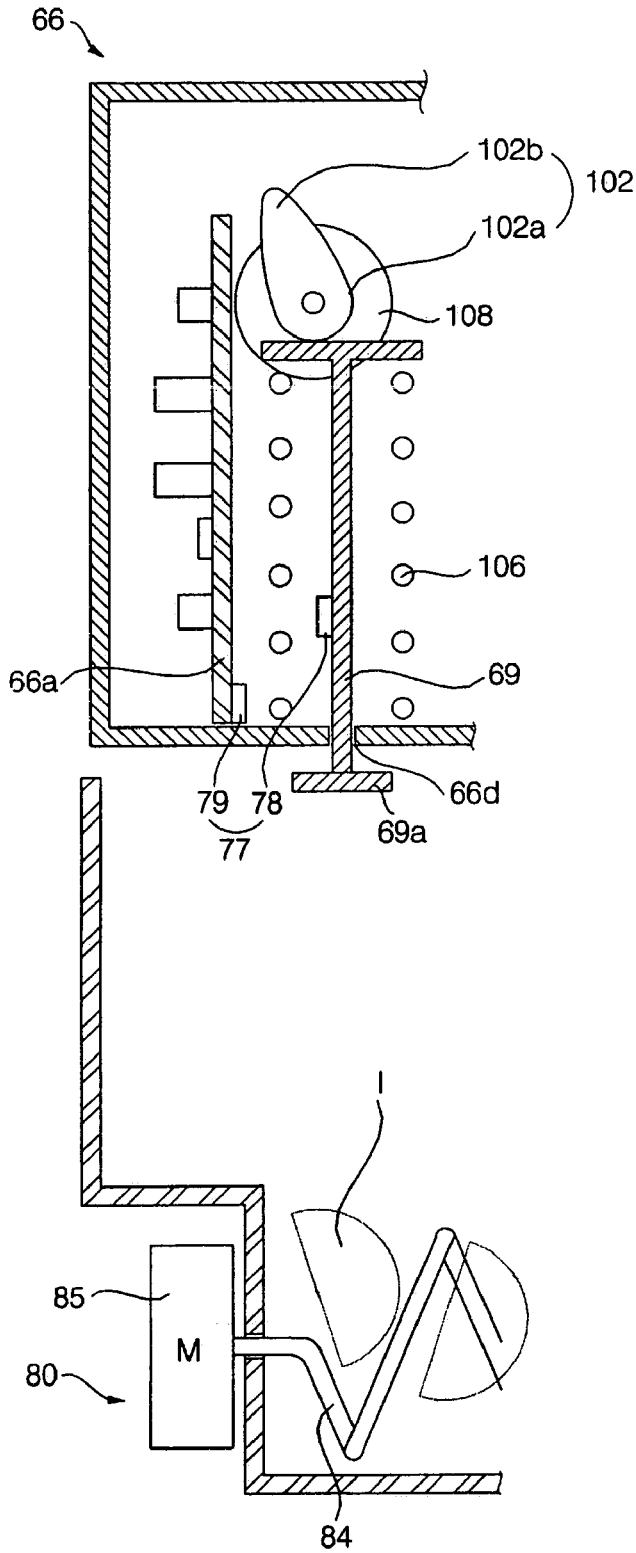
FIG. 9*a* is an enlarged sectional view of a full ice level sensing apparatus before or after a sensing mode in accordance with a second embodiment of the present invention.
Figure 9B:
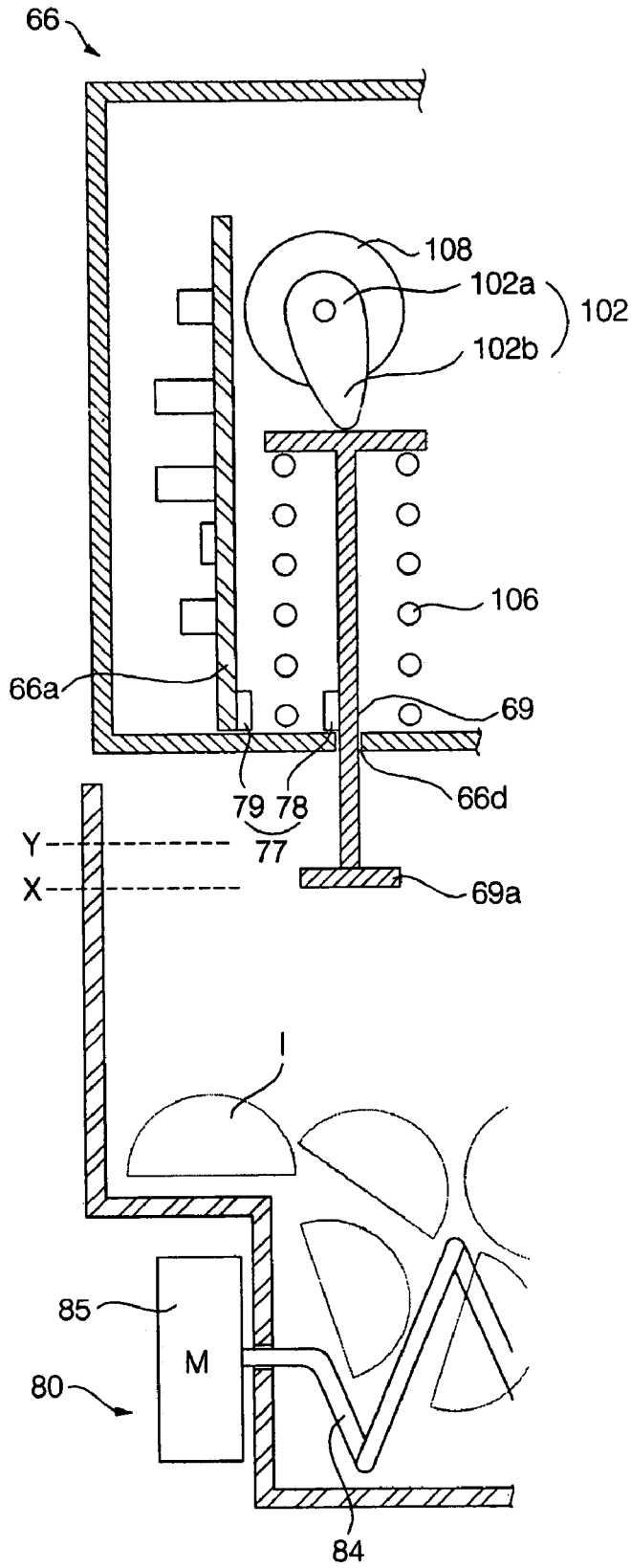
FIG. 9*b* is an enlarged sectional view of the full ice level sensing apparatus, when an ice bank is not at a full ice level, in accordance with the second embodiment of the present invention.
Figure 9C:
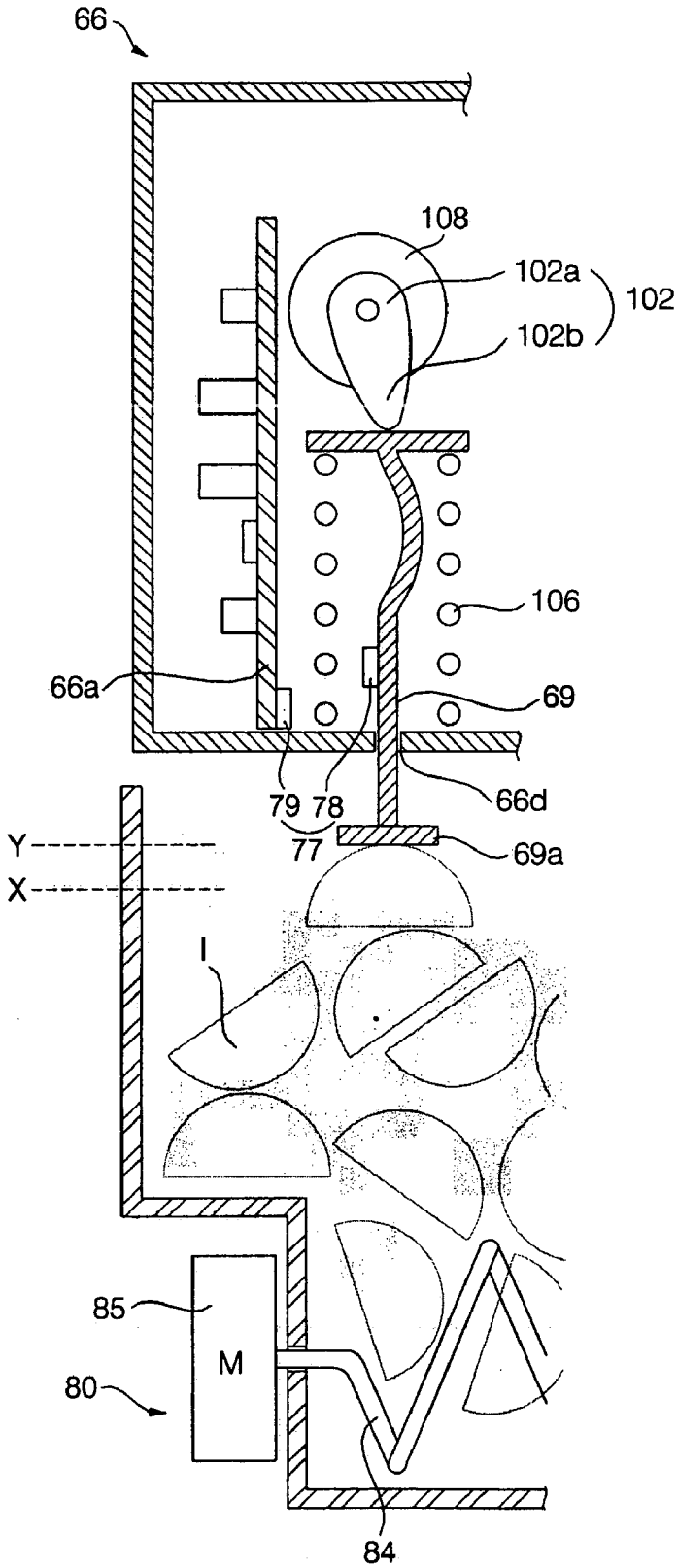
FIG. 9*c* is an enlarged sectional view of the full ice level sensing apparatus, when the ice bank is at the full ice level, in accordance with the second embodiment of the present invention.

FIG. 9*a* is an enlarged sectional view of a full ice level sensing apparatus before or after a sensing mode in accordance with a second embodiment of the present invention. FIG. 9*b* is an enlarged sectional view of the full ice level sensing apparatus, when an ice bank is not at a full ice level, in accordance with the second embodiment of the present invention. FIG. 9*c* is an enlarged sectional view of the full ice level sensing apparatus, when the ice bank is at the full ice level, in accordance with the second embodiment of the present invention.

As shown in FIGS. 9*a* to 9*c*, in the full ice level sensing apparatus in accordance with the second embodiment, an elevating means for elevating the elevating member 69 includes a cam 102 for lowering the elevating member 69, and a return spring 106 for elastically supporting the elevating member 69 so as to elevate the elevating member 69. Constructions and functions of other parts such as the elevating member 69 and the sensing means 77 of the second embodiment except for the above elevating means are substantially the same as those of the first embodiment, and detailed descriptions thereof will thus be omitted because they are considered to be unnecessary.

An upper end of the elevating member 69 contacts the cam 102 and is fixed to an upper end of the return spring 106.

Further, the elevating member 69 is made of an elastic material so as to be warped at the upper end thereof.

The elevating means further includes a motor 108 for rotating the cam 102.

Here, the cam 102 is axially connected to the motor 108, so as to be rotated. However, in the same manner as the first embodiment, the cam 102 of the second embodiment may be geared with one of either the driving motor 66*b*, the driving gear 66*c* or the driven gear 62*c* for rotating the ejector 62, so as to be rotated.

In other modes than a full ice level sensing mode, as shown in FIG. 9*a*, the full ice level sensing apparatus controls the motor 108 such that a portion 102*a* other than a nose 102*b* of the cam 102 contacts the elevating member 69.

Here, the elevating member 69 is elastically supported by the return spring 106, thereby rectilinearly moving up. Then, the lower end of the elevating member 69 maximally approaches the ice-making controller 66, thus minimizing the interference between the elevating member 69 and the separated ice cubes.

On the other hand, in the full ice level sensing mode, as shown in FIGS. 9*b* and 9*c*, the full ice level sensing apparatus controls the motor 108 such that the nose 102*b* of the cam 102 contacts and presses the elevating member 69.

Here, the elevating member 69 moves down to press the return spring 106.

In case that the ice bank 80 is not at the full ice level, as shown in FIG. 9*b*, the elevating member 69 rectilinearly moves down to the inside of the ice bank 80 and reaches the position (X) corresponding to the non-full ice level of the ice bank 80, and the hall sensor 79 senses a magnetic field having a value greater than a predetermined value according to the approximation of the magnet 78, thus allowing the control panel 66*a* to determine that the ice bank 80 is not at the full ice level.

On the other hand, in case that the ice bank 80 is at the full ice level, as shown in FIG. 9*c*, the elevating member 69 is restricted by the ice cubes (I) in the ice bank 80 and does not move down below the position (Y) corresponding to the full ice level of the ice bank 80, and the hall sensor 79 does not sense a magnetic field having a value greater than the predetermined value, thus allowing the control panel 66*a* to determine that the ice bank 80 is at the full ice level. Here, the upper portion of the elevating member 69 is warped in the breadthwise direction, thereby preventing the cam 102 or the motor 108 from being damaged due to the restriction of the elevating member 69.

Figure 10A:
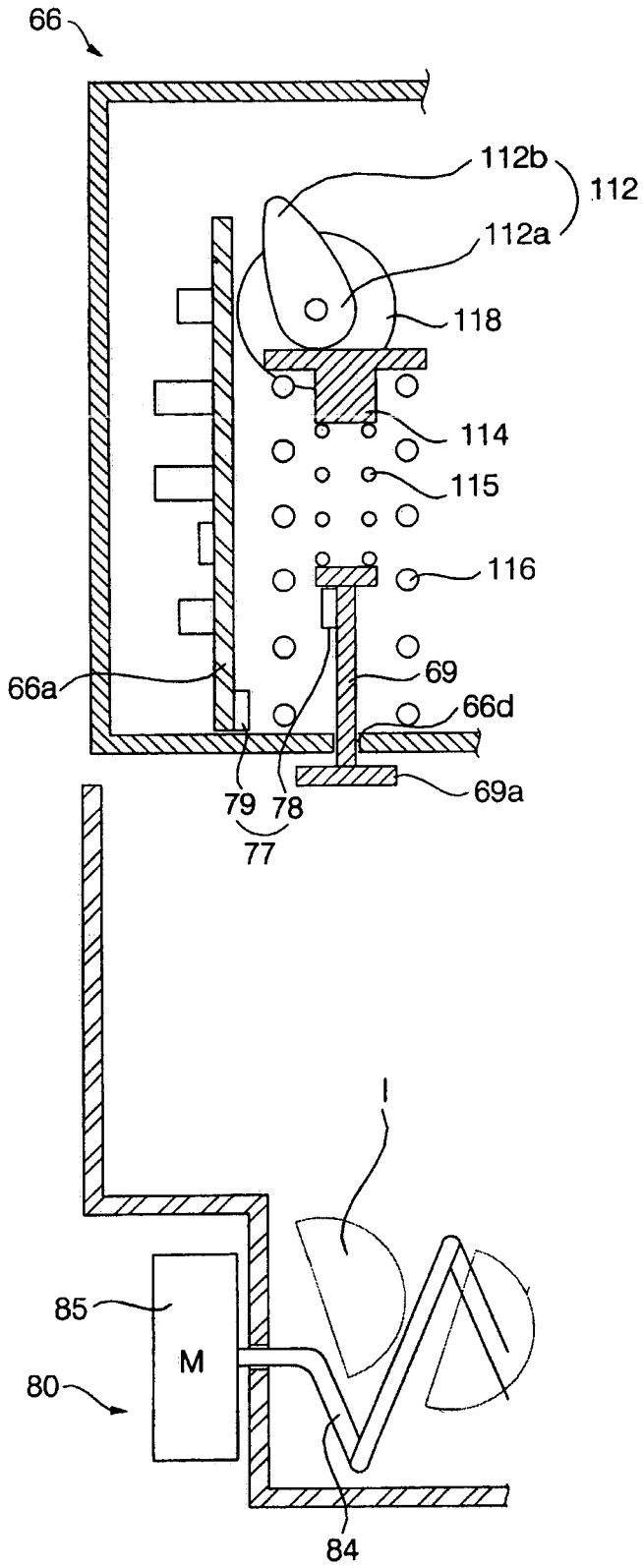
FIG. 10*a* is an enlarged sectional view of a full ice level sensing apparatus before or after a sensing mode in accordance with a third embodiment of the present invention.
Figure 10B:
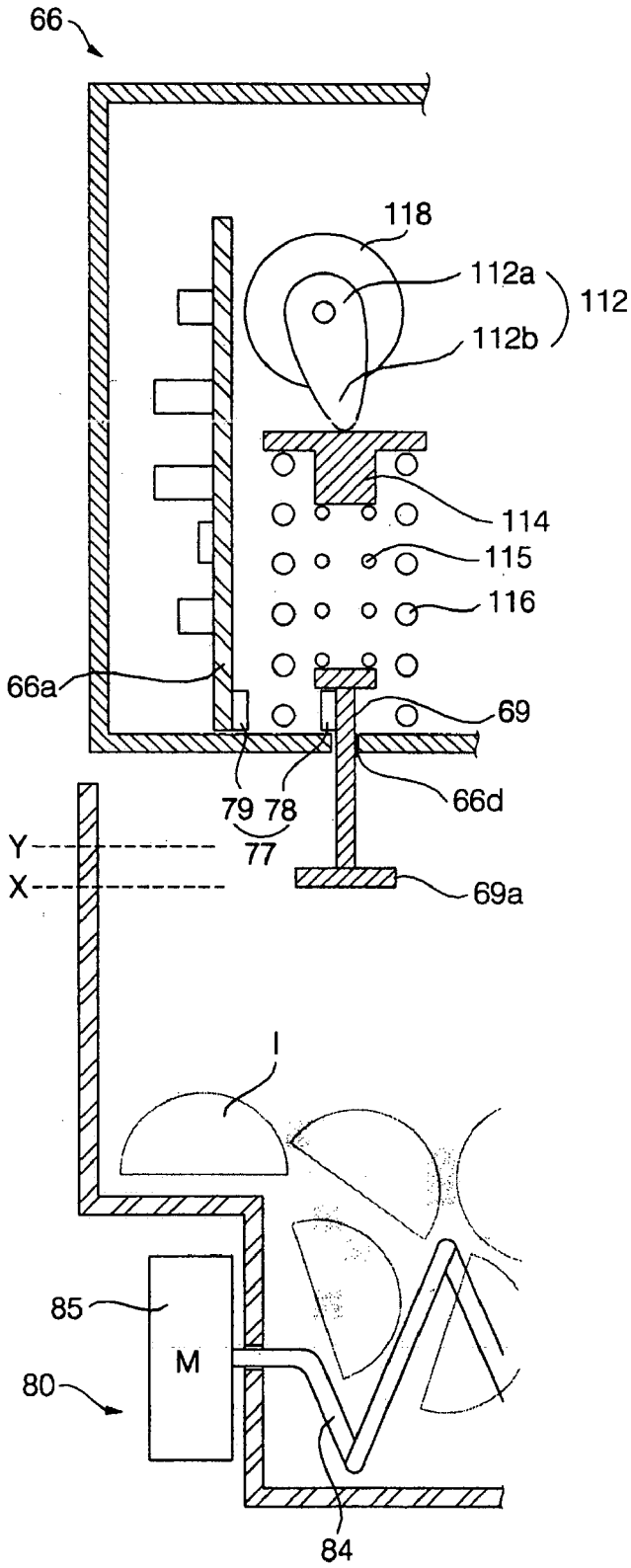
FIG. 10*b* is an enlarged sectional view of the full ice level sensing apparatus, when an ice bank is not at a full ice level, in accordance with the third embodiment of the present invention.
Figure 10C:
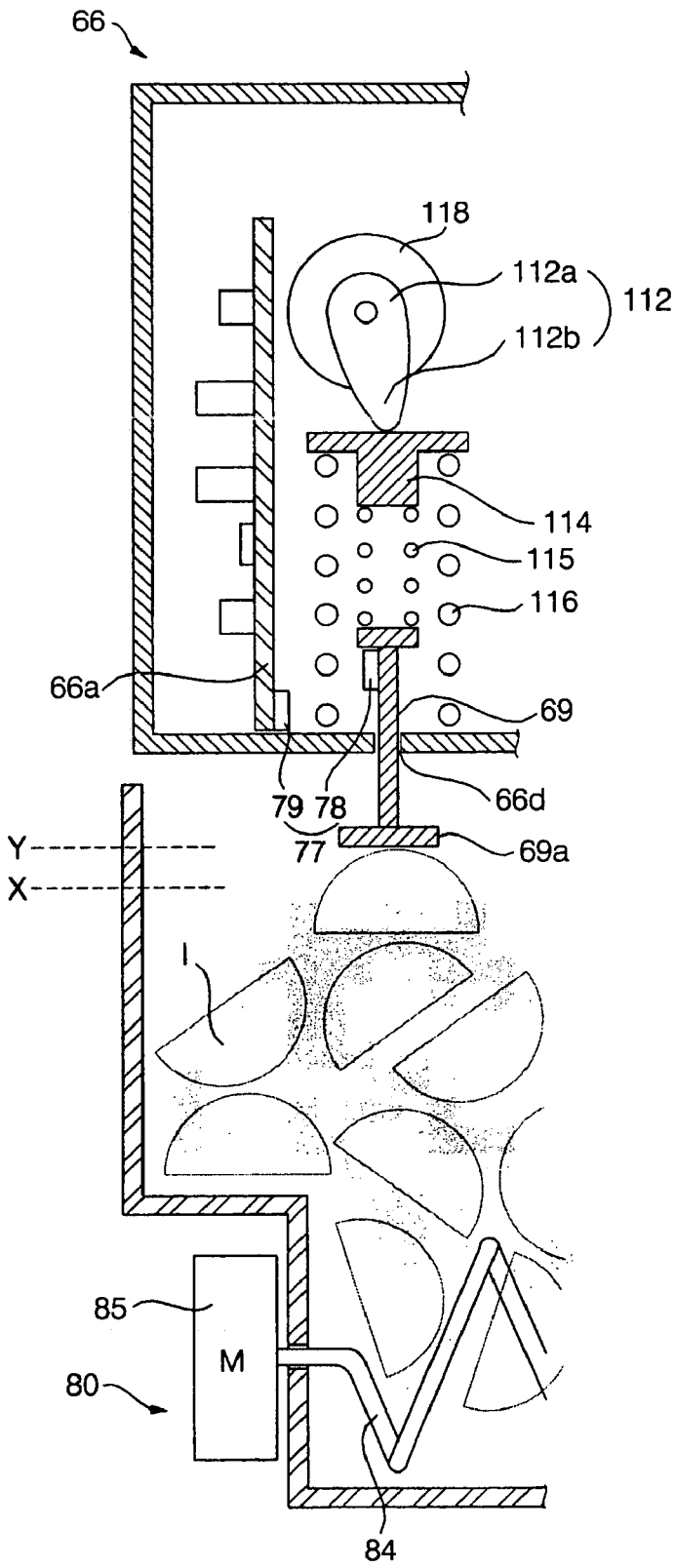
FIG. 10*c* is an enlarged sectional view of the full ice level sensing apparatus, when the ice bank is at the full ice level, in accordance with the third embodiment of the present invention.

FIG. 10*a* is an enlarged sectional view of a full ice level sensing apparatus before or after a sensing mode in accordance with a third embodiment of the present invention. FIG. 10*b* is an enlarged sectional view of the full ice level sensing apparatus, when an ice bank is not at a full ice level, in accordance with the third embodiment of the present invention. FIG. 10*c* is an enlarged sectional view of the full ice level sensing apparatus, when the ice bank is at the full ice level, in accordance with the third embodiment of the present invention.

As shown in FIGS. 10*a* to 10*c*, in the full ice level sensing apparatus in accordance with the third embodiment, an elevating means for elevating the elevating member 69 includes a cam 112, a pressure board 114 contacting the cam 112, a compression spring 115 provided with one end connected to the pressure board 114 and the other end connected to the elevating member 69, and a return spring 116 for elevating the pressure board 114. Constructions and functions of other parts such as the elevating member 69 and the sensing means 77 of the third embodiment except for the above elevating means are substantially the same as those of the first embodiment, and detailed descriptions thereof will thus be omitted because they are considered to be unnecessary.

An upper end of the pressure board 114 contacts the cam 112.

An upper end of the compression spring 115 is fixed to a lower surface of the pressure board 114, and a lower end of the compression spring 115 is fixed to the upper end of the elevating member 69.

The elevating means further includes a motor 118 for rotating the cam 112.

Here, the cam 112 is axially connected to the motor 118, so as to be rotated. However, in the same manner as the first embodiment, the cam 112 of the third embodiment may be geared with one of either the driving motor 66*b*, the driving gear 66*c* or the driven gear 62*c* for rotating the ejector 62, so as to be rotated.

In other modes other than a full ice level sensing mode, as shown in FIG. 10*a*, the full ice level sensing apparatus controls the motor 118 such that a portion 112*a* other than a nose 112*b* of the cam 112 contacts the pressure board 114.

Here, the pressure board 114 rectilinearly moves up by the return spring 116, and the elevating member 69 rectilinearly moves up together with the upward movement of the pressure board 114. Then, the lower end of the elevating member 69 maximally approaches the ice-making controller 66, thus minimizing the interference between the elevating member 69 and the separated ice cubes.

On the other hand, in the full ice level sensing mode, as shown in FIGS. 10*b* and 10*c*, the full ice level sensing apparatus controls the motor 118 such that the nose 112*b* of the cam 112 contacts and presses the pressure board 114.

Here, the pressure board 114 moves down to press the return spring 116, and the downward movement of the pressure board 114 is transmitted to the elevating member 69 through the compression spring 115. Thereby, the elevating member 69 rectilinearly moves down together with the downward movement of the pressure board 114 and the compression spring 115.

In case that the ice bank 80 is not at the full ice level, as shown in FIG. 10*b*, the elevating member 69 rectilinearly moves down to the inside of the ice bank 80 and reaches the position (X) corresponding to the non-full ice level of the ice bank 80, and the hall sensor 79 senses a magnetic field having a value greater than a predetermined value according to the approximation of the magnet 78, thus allowing the control panel 66*a* to determine that the ice bank 80 is not at the full ice level.

On the other hand, in case that the ice bank 80 is at the full ice level, as shown in FIG. 10*c*, the elevating member 69 is restricted by the ice cubes (I) in the ice bank 80 and does not move down below the position (Y) corresponding to the full ice level of the ice bank 80, and the hall sensor 79 does not sense a magnetic field having a value greater than the predetermined value, thus allowing the control panel 66*a* to determine that the ice bank 80 is at the full ice level. Here, the compression spring 115 is compressed between the pressure board 114 and the elevating member 69, thereby preventing the cam 112 or the motor 118 from being damaged due to the restriction of the elevating member 69.

Figure 11A:
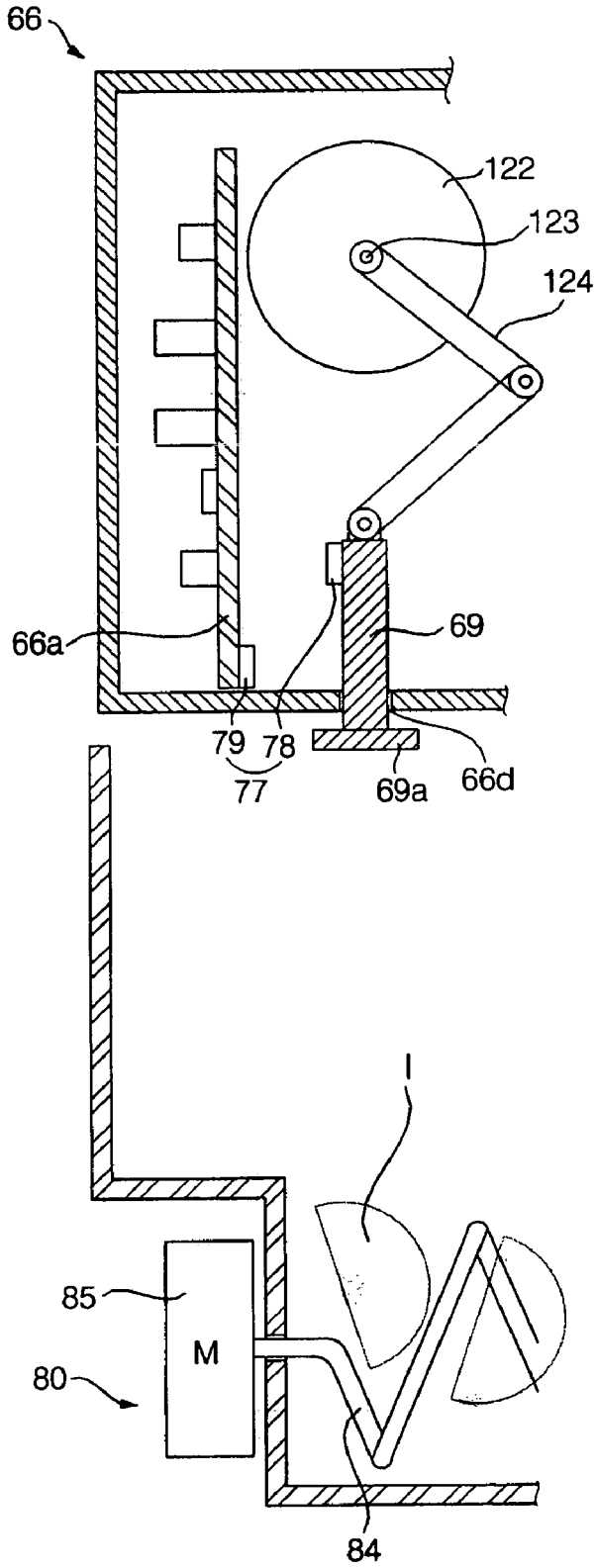
FIG. 11*a* is an enlarged sectional view of a full ice level sensing apparatus before or after a sensing mode in accordance with a fourth embodiment of the present invention.
Figure 11B:
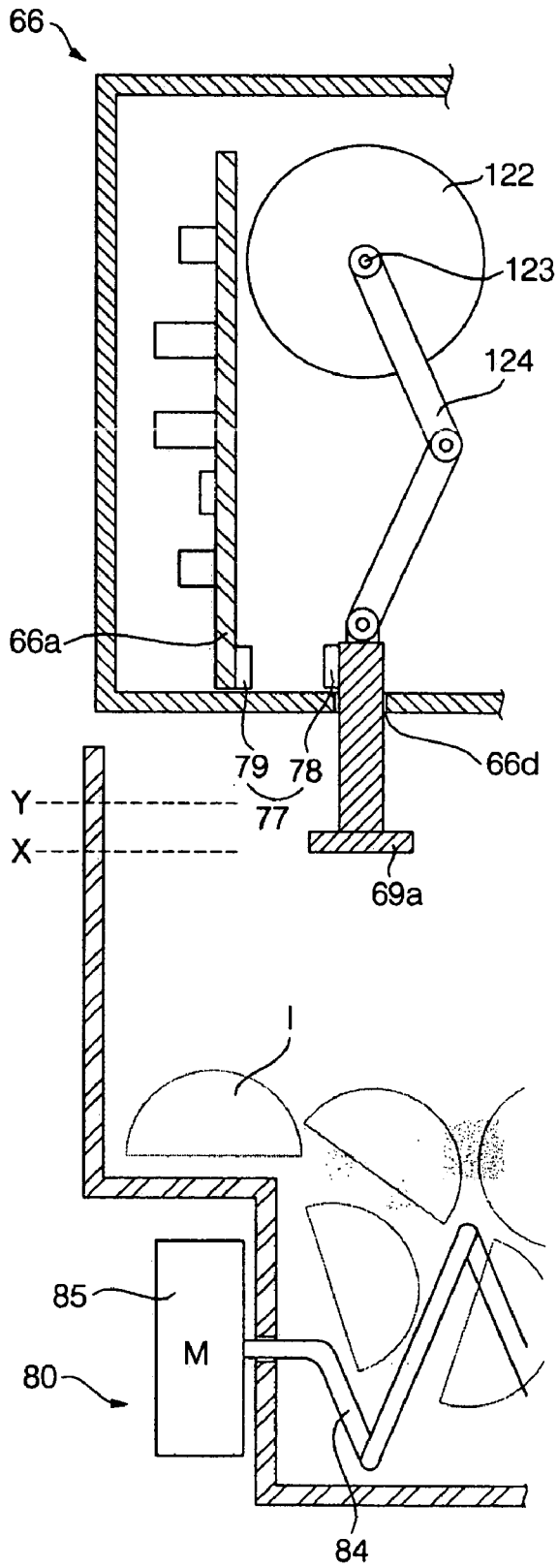
FIG. 11*b* is an enlarged sectional view of the full ice level sensing apparatus, when an ice bank is not at a full ice level, in accordance with the fourth embodiment of the present invention.
Figure 11C:
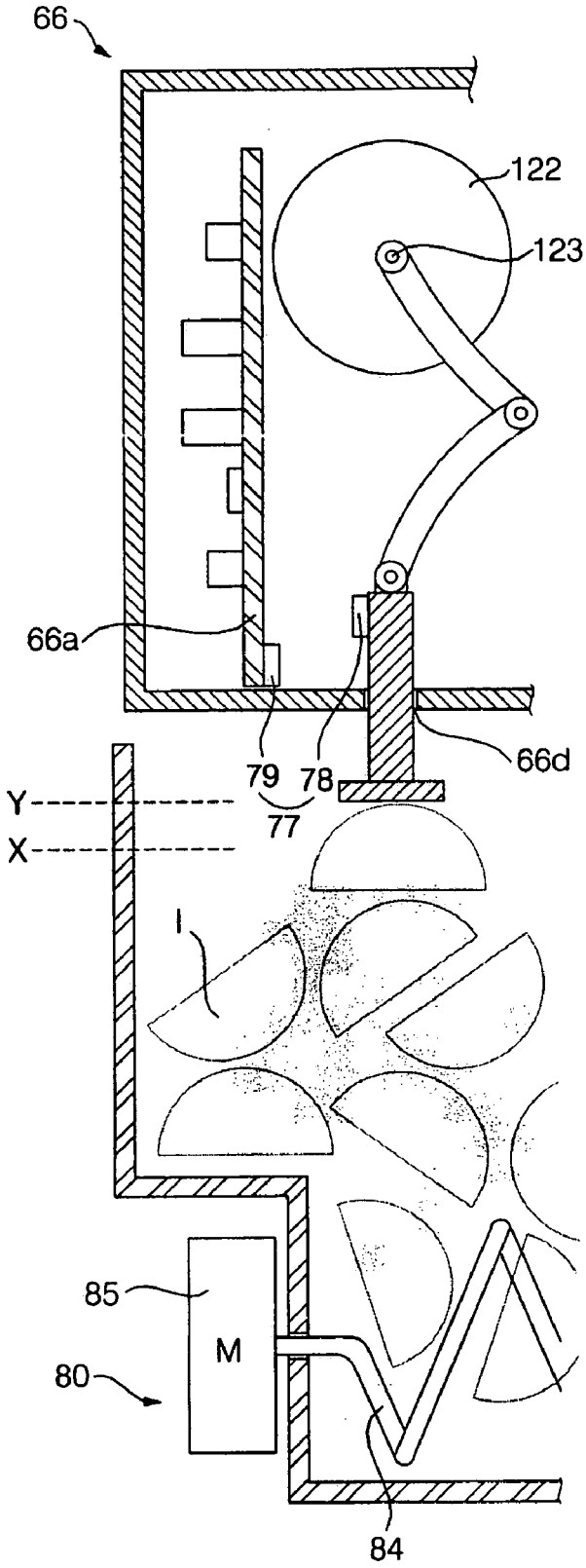
FIG. 11*c* is an enlarged sectional view of the full ice level sensing apparatus, when the ice bank is at the full ice level, in accordance with the fourth embodiment of the present invention.

FIG. 11*a* is an enlarged sectional view of a full ice level sensing apparatus before or after a sensing mode in accordance with a fourth embodiment of the present invention. FIG. 11*b* is an enlarged sectional view of the full ice level sensing apparatus, when an ice bank is not at a full ice level, in accordance with the fourth embodiment of the present invention. FIG. 11*c* is an enlarged sectional view of the full ice level sensing apparatus, when the ice bank is at the full ice level, in accordance with the fourth embodiment of the present invention.

As shown in FIGS. 11*a* to 11*c*, in the full ice level sensing apparatus in accordance with the fourth embodiment, an elevating means for elevating the elevating member 69 includes a motor 122, and a foldaway link 124 provided with one end connected to a shaft 123 of the motor 122 and the other end connected to the elevating member 69. Constructions and functions of other parts such as the elevating member 69 and the sensing means 77 of the fourth embodiment except for the above elevating means are substantially the same as those of the first embodiment, and detailed descriptions thereof will thus be omitted because they are considered to be unnecessary.

An upper end of the foldaway link 124 is fixed to the shaft 123 of the motor 122, and a lower end of the foldaway link 124 is rotatably connected to the upper end of the elevating member 69.

The foldaway link 124 is made of an elastic material so as to be warped at the central portion of each of the units thereof.

Here, the foldaway link 124 is connected to the motor 122, so as to be rotated. However, in the same manner as the first embodiment, the foldaway link 124 of the fourth embodiment may be geared with one of either the driving motor 66*b*, the driving gear 66*c* or the driven gear 62*c* for rotating the ejector 62, so as to be rotated.

In other modes than a full ice level sensing mode, as shown in FIG. 11*a*, the full ice level sensing apparatus controls the motor 122 such that the foldaway link 124 is maximally folded.

Here, the foldaway link 124 is provided with the lower end connected to the elevating member 69, thus rectilinearly moving the elevating member 69 upward. Then, the lower end of the elevating member 69 maximally approaches the ice-making controller 66, thus minimizing the interference between the elevating member 69 and the separated ice cubes.

On the other hand, in the full ice level sensing mode, as shown in FIGS. 11*b* and 11*c*, the full ice level sensing apparatus controls the motor 122 such that the foldaway link 124 presses the elevating member 69.

Here, the foldaway link 124 is gradually unfolded by the rotation of the shaft 123 of the motor 122, and the elevating member 69 is pressed by the foldaway link 124 by means of the unfolding of the foldaway link 124, and rectilinearly moves down.

In case that the ice bank 80 is not at the full ice level, as shown in FIG. 11*b*, the elevating member 69 rectilinearly moves down to the inside of the ice bank 80 and reaches the position (X) corresponding to the non-full ice level of the ice bank 80, and the hall sensor 79 senses a magnetic field having a value greater than a predetermined value according to the approximation of the magnet 78, thus allowing the control panel 66*a* to determine that the ice bank 80 is not at the full ice level.

On the other hand, in case that the ice bank 80 is at the full ice level, as shown in FIG. 11*c*, the elevating member 69 is restricted by the ice cubes (I) in the ice bank 80 and does not move down below the position (Y) corresponding to the full ice level of the ice bank 80, and the hall sensor 79 does not sense a magnetic field having a value greater than the predetermined value, thus allowing the control panel 66*a* to determine that the ice bank 80 is at the full ice level. Here, the foldaway link 124 has a limited unfolding angle, thereby preventing the motor 122 from being damaged due to the restriction of the elevating member 69.

Figure 12A:
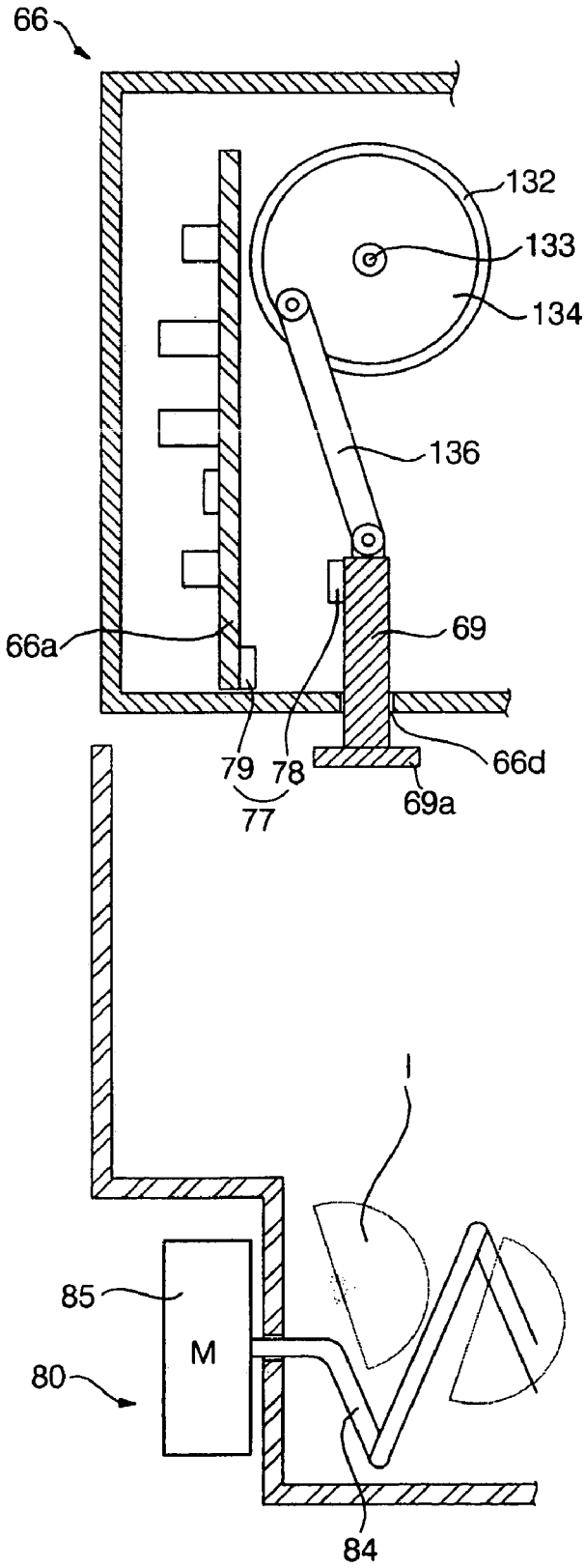
FIG. 12*a* is an enlarged sectional view of a full ice level sensing apparatus before or after a sensing mode in accordance with a fifth embodiment of the present invention.
Figure 12B:
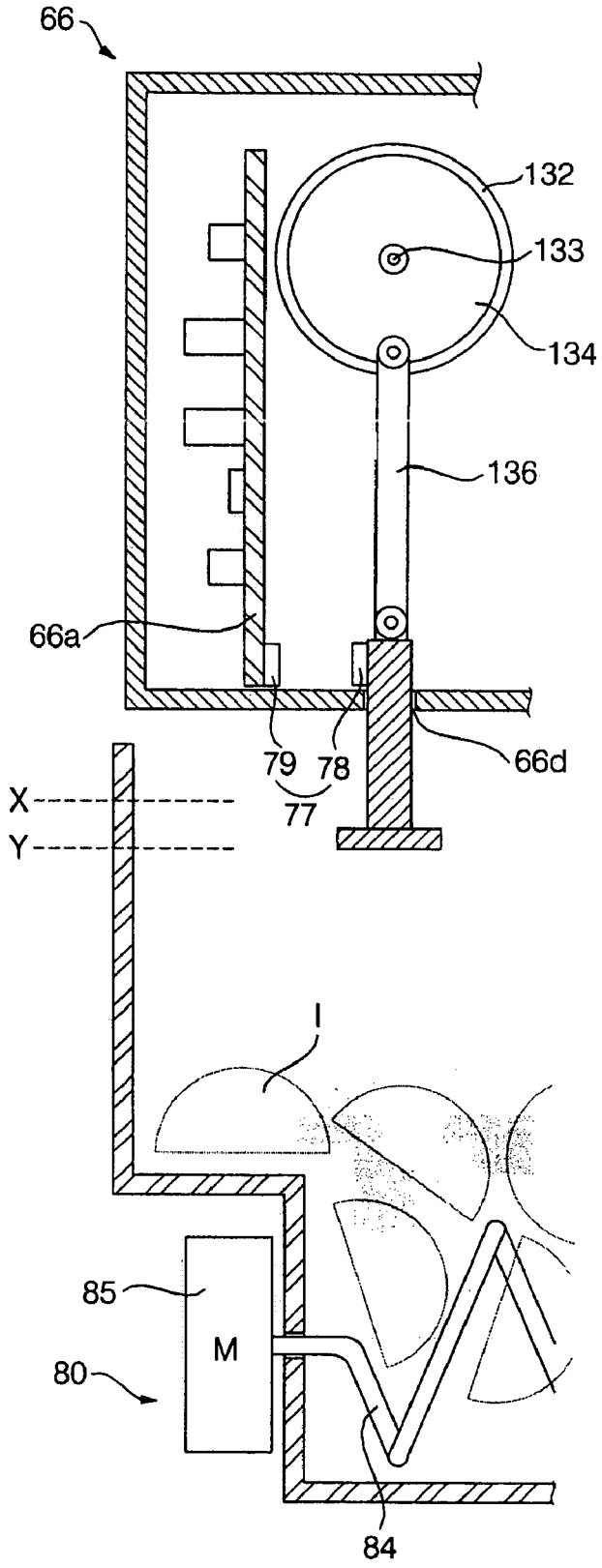
FIG. 12*b* is an enlarged sectional view of the full ice level sensing apparatus, when an ice bank is not at a full ice level, in accordance with the fifth embodiment of the present invention.
Figure 12C:
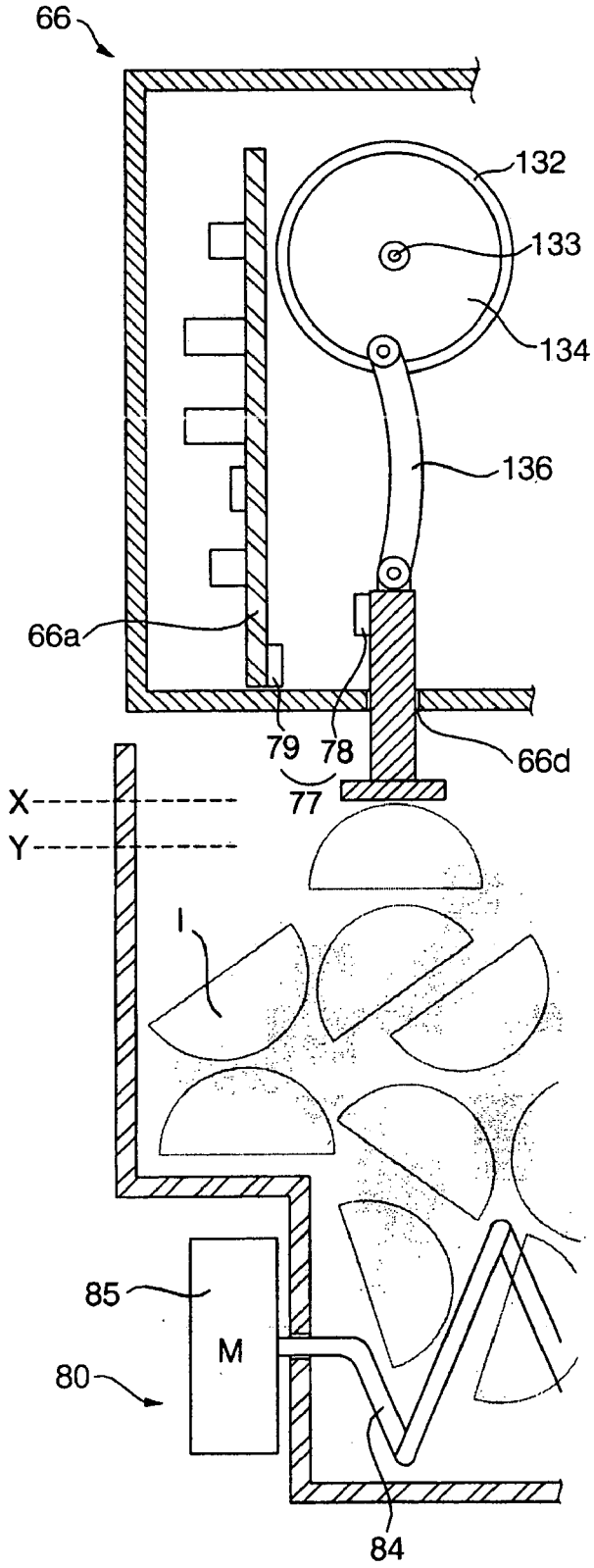
FIG. 12*c* is an enlarged sectional view of the full ice level sensing apparatus, when the ice bank is at the full ice level, in accordance with the fifth embodiment of the present invention.

FIG. 12*a* is an enlarged sectional view of a full ice level sensing apparatus before or after a sensing rode in accordance with a fifth embodiment of the present invention. FIG. 12*b* is an enlarged sectional view of the full ice level sensing apparatus, when an ice bank is not at a full ice level, in accordance with the fifth embodiment of the present invention. FIG. 12*c* is an enlarged sectional view of the full ice level sensing apparatus, when the ice bank is at the full ice level, in accordance with the fifth embodiment of the present invention.

As shown in FIGS. 12*a* to 12*c*, in the full ice level sensing apparatus in accordance with the fifth embodiment, an elevating means for elevating the elevating member 69 includes a motor 132, a rotor 123 connected to a shaft 133 of the motor 132, and a link 136 provided with one end eccentrically connected to the rotor 134 and the other end connected to the elevating member 69. Constructions and functions of other parts such as the elevating member 69 and the sensing means 77 of the fifth embodiment except for the above elevating means are substantially the same as those of the first embodiment, and detailed descriptions thereof will thus be omitted because they are considered to be unnecessary.

The rotor 134 is formed in a disk shape, and the rotary shaft 133 of the motor 132 is fixed into the central portion of the rotor 134.

An upper end of the link 136 is rotatably connected to a portion of the edge of the rotor 134, and a lower end of the link 136 is rotatably connected to the upper end of the elevating member 69.

The link 136 is made of an elastic material so as to be warped in the breadthwise direction at the central portion thereof.

Here, the link 136 is connected to the motor 132, so as to be rotated. However, in the same manner as the first embodiment, the link 136 of the fifth embodiment may be geared with one of either the driving motor 66*b*, the driving gear 66*c* or the driven gear 62*c* for rotating the ejector 62, so as to be rotated.

In other modes than a full ice level sensing mode, as shown in FIG. 12*a*, the full ice level sensing apparatus controls the motor 132 such that the upper end of the link 136 reaches a level having the same or similar height as or to that of the rotary shaft 133 of the motor 132.

Here, the rotor 134 is rotated to lift up the link 136, and the link 136 provided with the lower end connected to the elevating member 69 rectilinearly moves the elevating member 69 upward. Then, the lower end of the elevating member 69 maximally approaches the ice-making controller 66, thus minimizing the interference between the elevating member 69 and the separated ice cubes.

On the other hand, in the full ice level sensing mode, as shown in FIGS. 12*b* and 12*c*, the full ice level sensing apparatus controls the motor 132 such that the link 136 presses the elevating member 69.

Here, the upper end of the link 136 is gradually transferred by the rotation of the rotor 134 to a level having a height lower than that of the rotary shaft 133 of the motor 132, and the elevating member 69 is pressed by the link 136 by means of the transfer of the link 136 and rectilinearly moves down.

In case that the ice bank 80 is not at the full ice level, as shown in FIG. 12*b*, the elevating member 69 rectilinearly moves down to the inside of the ice bank 80 and reaches the position (X) corresponding to the non-full ice level of the ice bank 80, and the hall sensor 79 senses a magnetic field having a value greater than a predetermined value according to the approximation of the magnet 78, thus allowing the control panel 66*a* to determine that the ice bank 80 is not at the full ice level.

On the other hand, in case that the ice bank 80 is at the full ice level, as shown in FIG. 12*c*, the elevating member 69 is restricted by the ice cubes (I) in the ice bank 80 and does not move down below the position (Y) corresponding to the full ice level of the ice bank 80, and the hall sensor 79 does not sense a magnetic field having a value greater than the predetermined value, thus allowing the control panel 66*a* to determine that the ice bank 80 is at the full ice level. Here, the downward movement of the link 136 is limited and the link 136 is warped at the central portion thereof, thereby preventing the motor 132 from being damaged due to the restriction of the elevating member 69, or a connection portion between the link 136 and the rotor 134 or elevating member 69 from being damaged.

As described above, the full ice level sensing apparatus of the present invention comprises the elevating member disposed so as to move up and down into the ice bank, the elevating means for moving the elevating member upward and downward, and the sensing means for sensing whether or riot the ice bank is at a full ice level based on the position of the elevating member, thus minimizing an operational area of the elevating member required to sense the full ice level and increasing an effective volume of a freezing chamber.

Further, the full ice level sensing apparatus of the present invention minimizes the probability of interference with peripheral parts, thus reducing the probability of errors in operation and having an elongated life span.

Further, the elevating member includes an extension portion protruded from the lower end thereof, thus heightening the accuracy of sensing the full ice level.

Further, the elevating member is disposed such that it rectilinearly moves up and down, thus minimizing the operational area thereof.

Further, the elevating member includes a stopper caught by one side of the ice-maker, thus preventing the elevating member from being unintentionally separated from the ice-maker.

Further, the elevating means includes a rack formed along one side surface of the elevating member, and a pinion interdigitated with the rack for moving the elevating member upward and downward, thereby being simplified in structure.

Further, a shaft of a motor of the elevating means is made of an elastic material, and is warped when the ice bank is at the full ice level, thereby preventing the motor from being overloaded and elongating the life span of the motor.

Further, the elevating means includes a cam for moving the elevating member downward, and a return spring for elastically supporting the elevating member so as to move the elevating member upward, thus being simplified in structure and minimizing impact generated by the upward and downward movements of the elevating member.

Further, the elevating means includes a cam, a pressure board contacting the cam, a compression spring provided with one end connected to the pressure board and the other end connected to the elevating member, and a return spring for elastically supporting the elevating member so as to move the elevating member upward, thus minimizing impact generated by the upward and downward movement of the elevating member, and being prevented from being damaged.

Further, the elevating means includes a shaft, and a foldaway link provided with one end connected to the shaft and the other end connected to the elevating member, thus minimizing an operational area of the elevating member for sensing the full ice level, reducing the probability of errors in operation, and having an elongated life span.

Further, the elevating means includes a rotor, and a link provided with one end eccentrically connected to the rotor and the other end connected to the elevating member, thus minimizing an operational area of the elevating member for sensing the full ice level.

Moreover, the full ice level sensing method of the present invention senses whether or not the ice bank is at the full ice level by intervals of a predetermined time, thus sensing the full ice level of the ice bank regardless of the ice-making control of the ice-maker and accurately and rapidly sensing whether or not the ice bank is at the full ice level.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A full ice level sensing apparatus comprising:

an ice-maker that makes ice from water supplied thereto by cool air;

an ice bank that contains ice cubes separated from the ice-maker;

an elevating member disposed so as to move up and down in a generally linear direction into the ice bank, the elevating member being formed in a shape of a rod extending in a generally vertical direction;

a motor configured to move the elevating member upward and downward in a generally vertical direction; and a sensor that senses whether or not the ice bank is at a full ice level based on the position of the elevating member.

2. The full ice level sensing apparatus as set forth in claim 1, wherein the elevating member includes an extension portion protruded from the lower end thereof.

3. The full ice level sensing apparatus as set forth in claim 1, wherein the elevating member is disposed such that it rectilinearly moves up and down.

4. The full ice level sensing apparatus as set forth in claim 1, wherein the elevating member includes a stopper caught by one side of the ice-maker.

5. The full ice level sensing apparatus as set forth in claim 1, wherein the elevator includes: a cam for moving the elevating member downward; and a return spring for elastically supporting the elevating member so as to move the elevating member upward.

6. The full ice level sensing apparatus as set forth in claim 5, wherein the elevator further includes a motor for rotating the cam.

7. The full ice level sensing apparatus as set forth in claim 5, wherein the elevator is made of an elastic material such that an upper part of the elevating member is warped.

8. The full ice level sensing apparatus as set forth in claim 1, wherein the elevator includes: a cam; a pressure board contacting the cam; a compression spring provided with one end connected to the pressure board and the other end connected to the elevating member; and a return spring for elastically supporting the elevating member so as to move the elevating member upward.

9. The full ice level sensing apparatus as set forth in claim 8, wherein the elevator further includes a motor for rotating the cam.

10. The full ice level sensing apparatus as set forth in claim 1, wherein the elevator includes: a shaft; and a foldaway link provided with one end connected to the shaft and the other end connected to the elevating member.

11. The full ice level sensing apparatus as set forth in claim 10, wherein the elevator further includes a motor for rotating the shaft.

12. The full ice level sensing apparatus as set forth in claim 10, wherein the foldaway link is made of an elastic material.

13. The full ice level sensing apparatus as set forth in claim 1, wherein the elevator includes: a rotor; and a link provided with one end eccentrically connected to the rotor and the other end connected to the elevating member.

14. The full ice level sensing apparatus as set forth in claim 13, wherein the elevator further includes a motor for rotating the rotor.

15. The full ice level sensing apparatus as set forth claim 13, wherein the link is made of an elastic material.

16. The full ice level sensing apparatus as set forth in claim 1, wherein the sensor includes:

a magnet installed at one of both the elevating member and the ice-maker; and a hall sensor installed at the other one of both the elevating member and the ice-maker to sense the variation in a magnetic field according to the variation in the magnet.

17. A full ice level sensing apparatus comprising:

an ice-maker that makes ice from water supplied thereto by cool air;

an ice bank that contains ice cubes separated from the ice-maker;

an elevating member disposed so as to move up and down in a generally linear direction into the ice bank;

an elevator that moves the elevating member upward and downward; and a sensor that senses whether or not the ice bank is at a full ice level based on the position of the elevating member, wherein the elevator includes;

a rack formed along one side surface of the elevating member; and a pinion interdigitated with the rack to move the elevating member upward and downward.

18. The full ice level sensing apparatus as set forth in claim 17, wherein the elevator further includes a motor provided with a shaft, to which the pinion is axially connected, that rotates the pinion.

19. The full ice level sensing apparatus as set forth in claim 18, wherein the elevator or the shaft is made of an elastic material.

* * * * *